US009835975B2

(12) United States Patent
Matsuda et al.

(10) Patent No.: US 9,835,975 B2
(45) Date of Patent: Dec. 5, 2017

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventors: Kenji Matsuda, Numazu (JP); Ryoji Kusudo, Yokohama (JP); Teruhiko Sasaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/219,057

(22) Filed: Jul. 25, 2016

(65) Prior Publication Data

US 2017/0031267 A1 Feb. 2, 2017

(30) Foreign Application Priority Data

Jul. 31, 2015 (JP) ..... 2015-151531

(51) Int. Cl.
*G03G 15/08* (2006.01)

(52) U.S. Cl.
CPC . *G03G 15/0808* (2013.01); *G03G 2215/0132* (2013.01); *G03G 2215/0825* (2013.01)

(58) Field of Classification Search
CPC ..... G03G 15/0808; G03G 15/0825
See application file for complete search history.

(56) References Cited

U.S. PATENT DOCUMENTS 3,639,050 A * 2/1972 Staller ..... G03G 15/08 118/212
3,921,571 A * 11/1975 Moore ..... G03G 15/0801 118/698
3,921,578 A * 11/1975 Genthe ..... G03G 15/0801 399/294
3,948,493 A * 4/1976 Moser ..... G03G 15/0801 198/580
3,991,712 A * 11/1976 Genthe ..... G03G 15/0801 118/636
4,913,087 A * 4/1990 Saita ..... G03G 15/0844 222/109
5,614,996 A * 3/1997 Tanda ..... G03G 21/12 141/363
5,887,224 A * 3/1999 Mizuishi ..... G03G 15/0822 399/102
2003/0026629 A1* 2/2003 Kawamura ..... G03G 15/0806 399/281
2008/0170898 A1* 7/2008 Shimizu ..... G03G 21/105 399/350
2011/0033208 A1* 2/2011 Moon ..... G03G 15/0887 399/258

(Continued)

FOREIGN PATENT DOCUMENTS

JP 2008-170951 A 7/2008

*Primary Examiner* — G. M. Hyder
(74) *Attorney, Agent, or Firm* — Canon USA, Inc. I.P. Division

(57) ABSTRACT

A developing device includes a developing chamber having a developer bearing member for bearing a developer; and a container disposed below the developing chamber in a vertical direction, configured to contain the developer, and having an endless developer conveying belt with at least one fin portion for conveying the developer to the developing chamber.

25 Claims, 33 Drawing Sheets

(56) References Cited

U.S. PATENT DOCUMENTS

| | | | | |
|---|---|---|---|---|
| 2011/0194864 | A1* | 8/2011 | Nakatake | G03G 15/0877 399/27 |
| 2011/0236079 | A1* | 9/2011 | Sasaki | G03G 15/0808 399/281 |
| 2013/0022375 | A1* | 1/2013 | Shin | G03G 15/0808 399/281 |

* cited by examiner

DEVELOPING DEVICE, PROCESS CARTRIDGE, AND IMAGE FORMING APPARATUS

BACKGROUND OF THE INVENTION

Field of the Invention

The present invention relates to a developing device used in an image forming apparatus, and a process cartridge attachable to and detachable from the image forming apparatus.

The image forming apparatus is an apparatus configured to form an image on a recording medium using an electrophotographic image forming method. Examples of the electrophotographic image forming apparatus include an electrophotographic copier, an electrophotographic printer (e.g., laser beam printer, light-emitting diode (LED) printer), a facsimile machine, a word processor, and a multifunction peripheral (multifunction printer) which combines the devices described above.

The developing device is a device configured to visualize an electrostatic latent image on an image bearing member, such as an electrophotographic photosensitive drum, using a developer. The process cartridge is formed by combining a charging unit, a developing unit or cleaning unit, and an electrophotographic photosensitive drum serving as an image bearing member, so as to be attachable to and detachable from the main body of the electrophotographic image forming apparatus. The process cartridge may be formed by combining at least one of a charging unit, a developing unit, and a cleaning unit with an electrophotographic photosensitive drum, so as to be attachable to and detachable from the main body of the electrophotographic image forming apparatus. The process cartridge may be formed by combining at least a developing unit and an electrophotographic photosensitive drum, so as to be attachable to and detachable from the main body of the electrophotographic image forming apparatus.

Description of the Related Art

An image forming apparatus using an electrophotographic process, such as a printer, uniformly charges a photosensitive drum serving as an image bearing member, forms a latent image by selectively exposing the photosensitive drum to light, and visualizes the latent image with toner serving as a developer to form a toner image on the photosensitive drum. Then, the image forming apparatus performs image recording by transferring the toner image onto a recording medium, and applying heat and pressure to the transferred toner image to fix the toner image to the recording medium.

The image forming apparatus described above requires toner supply and maintenance on various processing units. To facilitate the toner supply and maintenance operation, a cartridge formed by putting together the photosensitive drum, charging unit, developing unit, and cleaning unit into a frame has been put to practical use.

In recent years, image forming apparatuses configured to form a color image by multicolor printing have been proposed. To meet demands for faster printing speeds and application to multifunction printers, an in-line type image forming apparatus has been proposed as a color image forming apparatus. The in-line type image forming apparatus includes a plurality of photosensitive drums which are designed for multicolor printing and arranged side by side in line in a horizontal direction.

Examples of the in-line type image forming apparatus including a plurality of photosensitive drums horizontally arranged include an image forming apparatus disclosed in Japanese Patent Laid-Open No. 2008-170951. This image forming apparatus has a configuration in which a plurality of photosensitive drums are arranged side by side below a transfer belt for transferring toner images, or below a recording-medium conveying belt for conveying a recording medium to which a toner image is transferred. This configuration is advantageous in that developing devices are less affected by heat from a fixing unit because, even in the main body of the image forming apparatus, the fixing unit can be placed away from the developing devices, with the transfer belt or the like interposed therebetween.

A developing device in each process cartridge is formed by combining a developing container and a toner container for containing toner. The developing container includes a developing roller for supplying a developer (toner) to an electrostatic latent image formed on a photosensitive drum, a toner supply roller for supplying toner to the developing roller, and a developer regulating member for regulating the amount of toner on the developing roller. The toner container has a blade-like stirring member and a toner opening. The toner in the toner container is conveyed by the stirring member through the toner opening to a developing chamber.

SUMMARY OF THE INVENTION

The present invention provides an improved developing device. Specifically, the present invention provides a developing device and a process cartridge capable of stably supplying a developer to a developing chamber.

A developing device according to an embodiment of the present invention includes a developing chamber having a developer bearing member for bearing a developer; and a container disposed below the developing chamber in a vertical direction, configured to contain the developer, and having an endless developer conveying belt with at least one fin portion for conveying the developer to the developing chamber.

Further features of the present invention will become apparent from the following description of exemplary embodiments with reference to the attached drawings.

DESCRIPTION OF THE EMBODIMENTS

Exemplary embodiments of the present invention will now be described in detail with reference to the drawings. The dimensions, materials, shapes and relative arrangement of components described in the following embodiments should be changed appropriately depending on the configuration and various conditions of devices and apparatuses to which the present invention is applied. Therefore, the scope of the present invention is not intended to be limited to the following embodiments unless otherwise specified.

First Embodiment

A color electrophotographic image forming apparatus (hereinafter referred to as an image forming apparatus) and a process cartridge (hereinafter referred to as a cartridge) according to a first embodiment will be described.

(General Configuration of Image Forming Apparatus)

Figure 1:
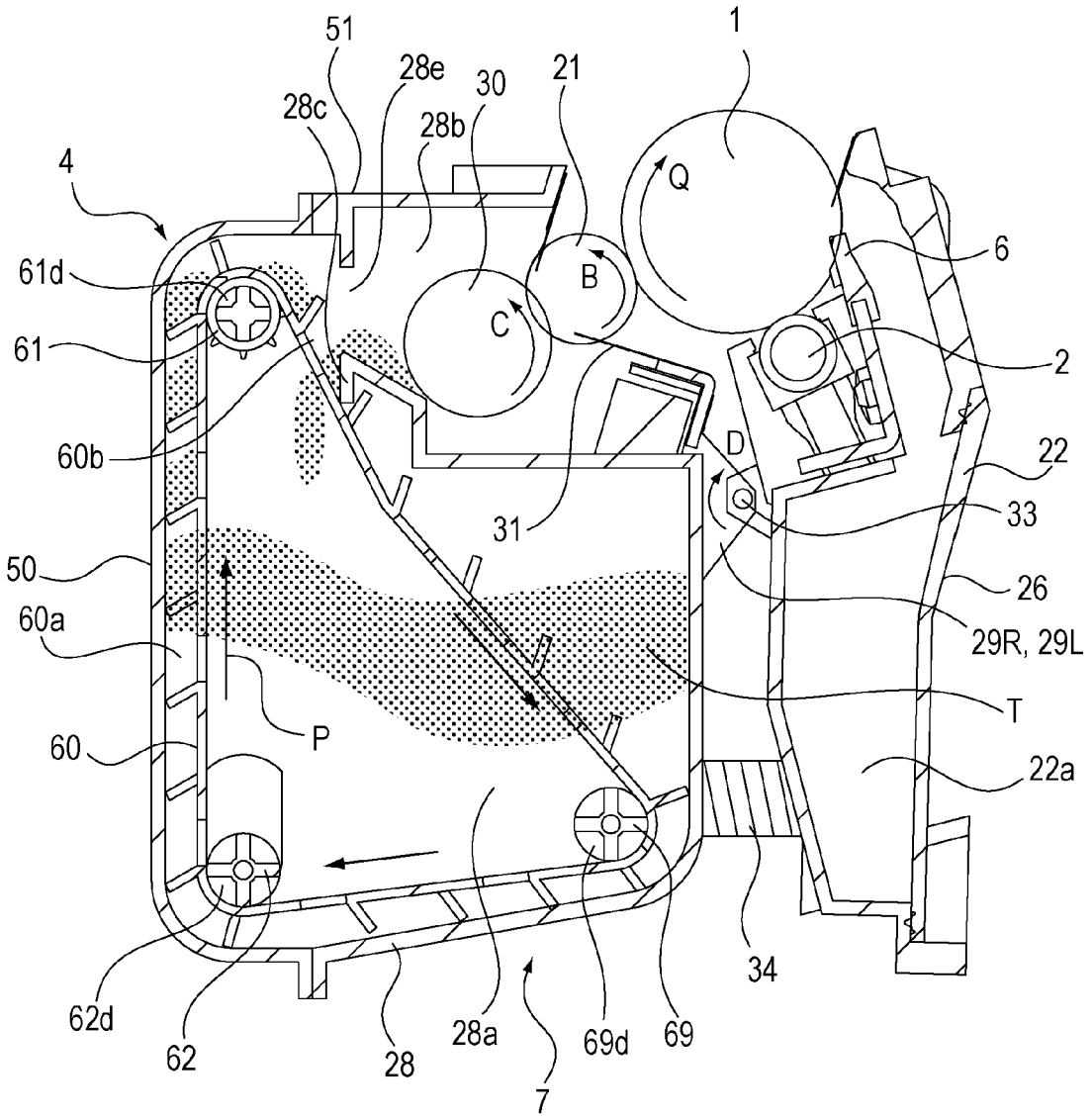
FIG. 1 is a cross-sectional view of a cartridge according to a first embodiment.
Figure 2:
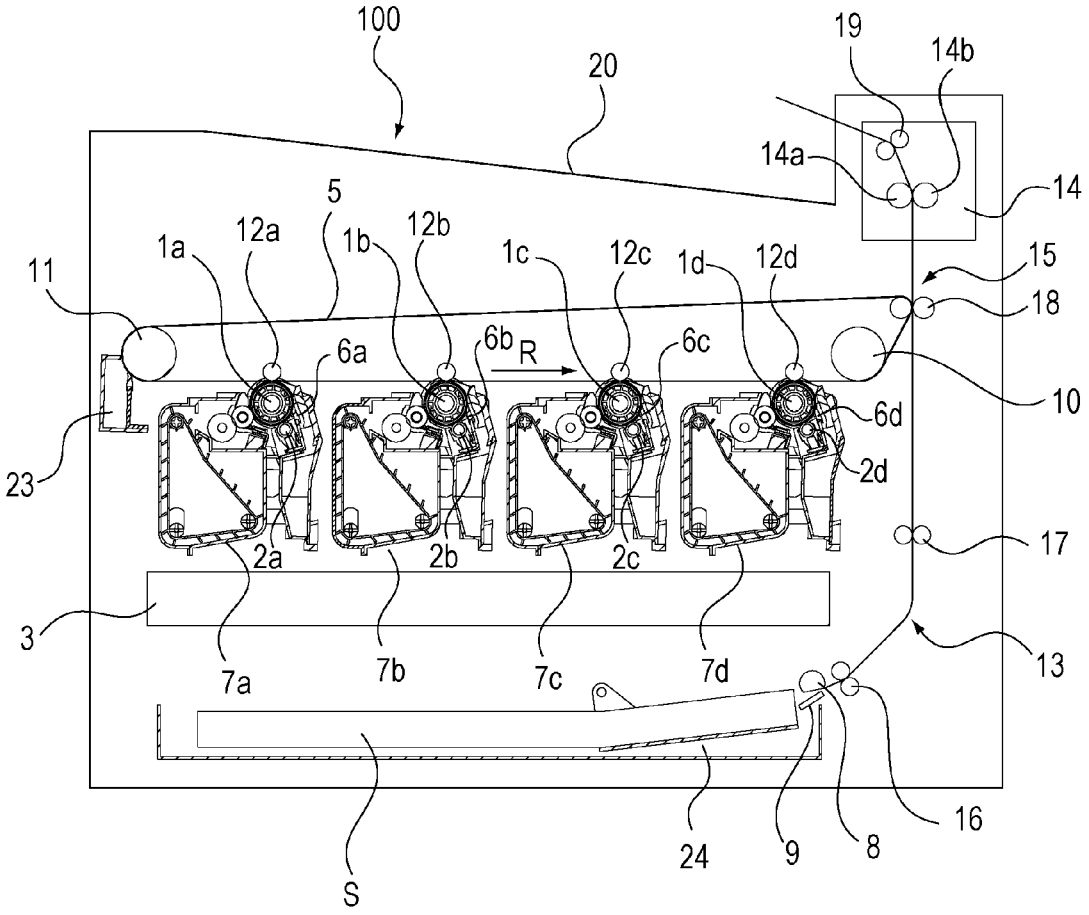
FIG. 2 is a cross-sectional view of a color electrophotographic image forming apparatus according to the first embodiment.

A general configuration of the image forming apparatus will be described with reference to FIG. 2. FIG. 2 is a principal cross-sectional view of an image forming apparatus 100 according to the first embodiment. Also, a cartridge 7 will be described with reference to FIG. 1 while the details will be described later on. FIG. 1 is a principal cross-sectional view of the cartridge 7 containing toner T according to the first embodiment.

The image forming apparatus 100 includes electrophotographic photosensitive drums 1 (hereinafter referred to as photosensitive drums) which are image bearing members arranged side by side in a horizontal direction. The photosensitive drums 1 are each driven by a driving member (not shown) to rotate in the direction of arrow Q (see FIG. 1). Each photosensitive drum 1 is surrounded by the following processing units, which are arranged sequentially in the direction of rotation of the photosensitive drum 1 and configured to act on the photosensitive drum 1. The processing units surrounding the photosensitive drum 1 include a cleaning member 6 configured to remove a developer (hereinafter referred to as toner) remaining on the surface of the photosensitive drum 1 after transfer, a charging roller 2 configured to uniformly charge the surface of the photosensitive drum 1, and a developing device 4 configured to develop an electrostatic latent image using toner. As illustrated in FIG. 2, the image forming apparatus 100 also includes a scanner unit 3 and an intermediate transfer belt 5. The scanner unit 3 is configured to emit laser beams on the basis of image information to form electrostatic latent images on the photosensitive drums 1. Toner images of four colors on the photosensitive drums 1 are transferred onto the intermediate transfer belt 5. Each photosensitive drum 1 and the cleaning member 6, the charging roller 2, and the developing device 4 arranged therearound are combined to form the cartridge 7. The cartridge 7 is detachably attached to the image forming apparatus 100 by the user.

The intermediate transfer belt 5 is stretched over a driving roller 10 and a tension roller 11. Primary transfer rollers 12 (12*a* to 12*d*) are arranged on the inner side of the intermediate transfer belt 5 to face the respective photosensitive drums 1 (1*a* to 1*d*). A bias applying unit (not shown) applies a transfer bias to the intermediate transfer belt 5.

As the photosensitive drums 1 rotate in the direction of arrow Q (see FIG. 1) and the intermediate transfer belt 5 runs in the direction of arrow R (see FIG. 2), the toner images (developer images) formed on the photosensitive drums 1 are sequentially primary-transferred onto the intermediate transfer belt 5 by applying a positive bias to the primary transfer rollers 12. The toner images of four colors superimposed on the intermediate transfer belt 5 are conveyed to a secondary transfer unit 15.

In synchronization with the image forming operation described above, a sheet S (recording medium) is conveyed by a conveying unit including a feeding device 13 and a registration roller pair 17. The feeding device 13 includes a feeding cassette 24 containing sheets S, a feeding roller 8 configured to feed a sheet S, and a conveying roller pair 16 configured to convey the fed sheet S. The feeding cassette 24 can be pulled out toward the front of the main body of the image forming apparatus 100 in FIG. 2. The sheets S contained in the feeding cassette 24 are separated and conveyed one by one by a separating pad 9 while being pressed into contact with the feeding roller 8 (frictional piece separation technique).

The sheet S conveyed from the feeding device 13 is further conveyed by the registration roller pair 17 to the secondary transfer unit 15, where a positive bias is applied to secondary transfer rollers 18. This causes the toner image of four colors on the intermediate transfer belt 5 to be secondary-transferred onto the conveyed sheet S.

A fixing unit 14 is configured to fix the toner image on the sheet S by applying heat and pressure thereto. A fixing belt 14*a* has a cylindrical shape, and is guided by a belt guide member (not shown) having a heating unit, such as a heater, bonded thereto. The fixing belt 14*a* and a pressure roller 14*b* form a fixing nip with a predetermined contact pressure.

The sheet S conveyed from the image forming unit and having an unfixed toner image thereon is subjected to heat and pressure at the fixing nip between the fixing belt 14*a* and the pressure roller 14*b*. Thus, the unfixed toner image on the sheet S is fixed to the sheet S. Then, the sheet S having the fixed toner image thereon is discharged by a discharge roller pair 19 to a discharge tray 20.

Toner remaining on the surface of each photosensitive drum 1 after toner image transfer is removed by the cleaning member 6. The removed toner is collected in a removed toner chamber 22*a* (see FIG. 1) in a photosensitive unit 26.

Toner remaining on the intermediate transfer belt 5 after secondary transfer onto the sheet S is removed by a transfer belt cleaning device 23 (see FIG. 2). The removed toner passes through a waste toner conveying path (not shown) and is collected in a waste toner collection container (not shown) disposed at the back of the apparatus.

(Configuration of Cartridge)

The cartridge 7 to which the present invention is applied will be described with reference to FIG. 1. FIG. 1 is a principal cross-sectional view of the cartridge 7 containing toner T according to the first embodiment. Note that FIG. 2 illustrates an exemplary image forming apparatus in which four cartridges 7 containing respective toners of yellow, magenta, cyan, and black are arranged side by side. A cartridge 7*a* containing yellow toner, a cartridge 7*b* containing magenta toner, a cartridge 7*c* containing cyan toner, and a cartridge 7*d* containing black toner have the same configuration.

Each cartridge 7 is formed by the photosensitive unit 26 including the photosensitive drum 1, and the developing device 4 including a developer bearing member (hereinafter referred to as a developing roller) 21. Each component will now be described.

The developing device 4 includes the developing roller 21 that rotates in the direction of arrow B while being in contact with the photosensitive drum 1, a developing frame 28, a lid member 50, and a mandible-like member 51. The developing roller 21 is rotatably supported by the developing frame 28, with developing side plates 29R and 29L attached to both sides of the developing frame 28 interposed therebetween. A developing chamber 28*b* includes a developer supply member (hereinafter referred to as a toner supply roller) 30 rotating in the direction of arrow C while being in contact with the developing roller 21, and a developing blade 31 for regulating the thickness of a toner layer on the developing roller 21. A container 28*a* disposed below the developing chamber 28*b* includes a developer conveying belt 60 configured to stir the toner T in the container 28*a* and serve as a supply unit for supplying toner to the developing chamber 28*b*.

The photosensitive drum 1 is rotatably attached to a cleaning frame 22, with a bearing (not shown) interposed therebetween. The charging roller 2 and the cleaning member 6 are disposed on the periphery of the photosensitive drum 1. Residual toner removed from the surface of the photosensitive drum 1 by the cleaning member drops into the removed toner chamber 22*a*. The photosensitive drum 1 is driven to rotate in accordance with the image forming operation, by the driving force of a driving motor (not shown) transmitted to the photosensitive unit 26.

The developing device 4 is coupled to the photosensitive unit 26 such that it can swing about a coupling shaft 33 engaged in holes in the plates 29R and 29L. During image formation in the cartridge 7, the developing device 4 is biased by a developing-device pressure spring 34 and pivots about the coupling shaft 33 in the direction of arrow D. Thus, the developing roller develops an electrostatic latent image on the photosensitive drum 1 while being in contact with the photosensitive drum 1. During non-image formation, the developing device 4 is biased by a developing-device biasing member (not shown) in the direction opposite the direction of pressure applied by the developing-device pressure spring 34. This causes the developing roller 21 to be separated from the photosensitive drum 1. The developing roller 21 is thus separated from the photosensitive drum 1 during non-image formation. This is to prevent the surface of the developing roller 21 having elasticity from being deformed at the contact nip between the photosensitive drum 1 and the developing roller 21. During the separation, the developing device 4 is not driven, and no sliding stress is applied to the developing roller 21, the toner supply roller 30, and the toner T in the developing device 4.

(Detailed Configuration of Developing Device)

The developer conveying belt 60 serves as a toner conveying unit in the present embodiment.

As illustrated in FIG. 1, a driving roller 61 and driven rollers 62 and 69 are inserted into the inner space of the developer conveying belt 60 of endless type. The driving roller 61 is disposed to a side of the developing chamber 28*b* in the horizontal direction, whereas the driven rollers 62 and 69 are disposed below the driving roller 61 and in the lower part of the container 28*a* in the vertical direction. The driven rollers 62 and 69 are disposed at both ends of the container 28*a* in the horizontal direction. The driven roller 69 is disposed to coincide with the photosensitive drum 1 in the vertical direction.

The driving roller 61 and the driven rollers 62 and 69 have a plurality of lightening portions 61*d*, 62*d*, and 69*d* to prevent an increase in torque during toner conveyance. The lightening portions 61*d*, 62*d*, and 69*d* are formed in both axial and radial directions.

The developer conveying belt 60 is stretched over the driving roller 61 and the two driven rollers 62 and 69 in a substantially triangular shape. The developer conveying belt 60 is in contact with a contact portion 28*c* of the developing frame 28 below the driving roller 61 in the vertical direction. The contact portion 28*c* is located below a supply opening 28*e* in the vertical direction. The developer conveying belt 60 is deflected on one side of the triangle by being partly in contact with the contact portion 28*c*. Although the developer conveying belt 60 is stretched over the three rollers in a substantially triangular shape in the present embodiment, the developer conveying belt 60 may be stretched in a rectangular, pentagonal, or other shape by adding one or more rollers depending on the shape of the container 28*a*.

The developer conveying belt 60 has a plurality of fin portions 60*a* integral therewith for conveying and stirring toner. The description of the fin portions 60*a* will be omitted here, as the more detailed description will be given later on. For example, a resin sheet made of polyethylene terephthalate (PET) resin, polycarbonate (PC) resin, or polyphenylene sulfide (PPS) resin may be used to form the developer conveying belt 60.

Figure 3:
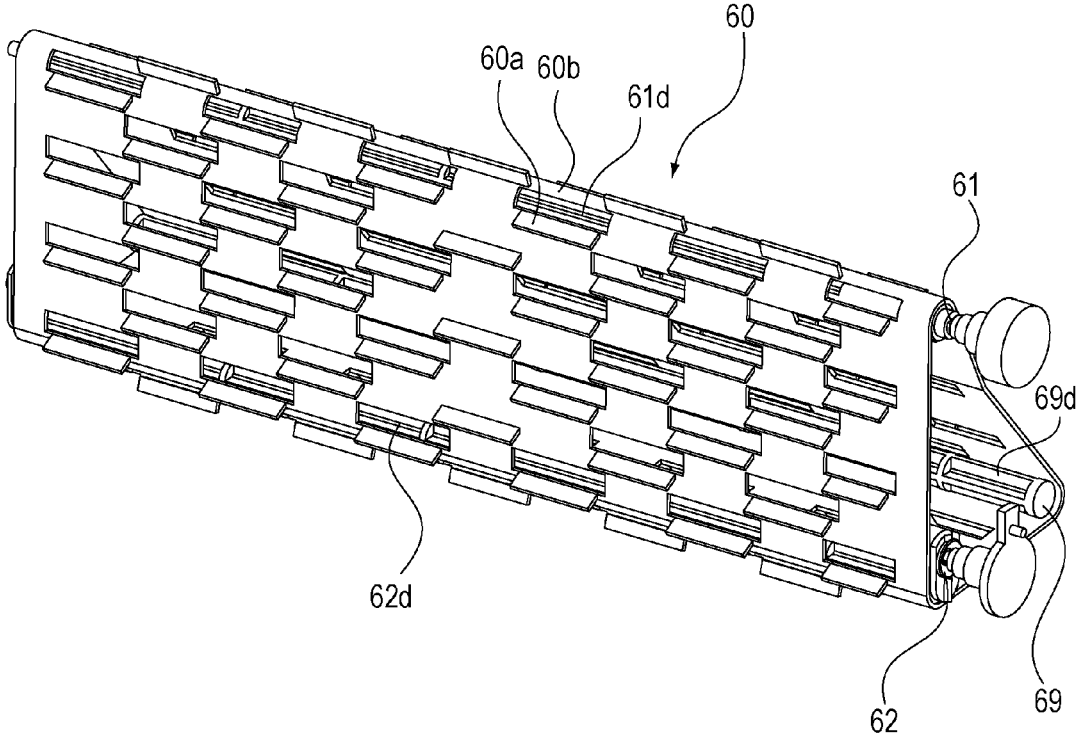
FIG. 3 is a perspective view of a toner conveying belt according to the first embodiment.
Figure 4:
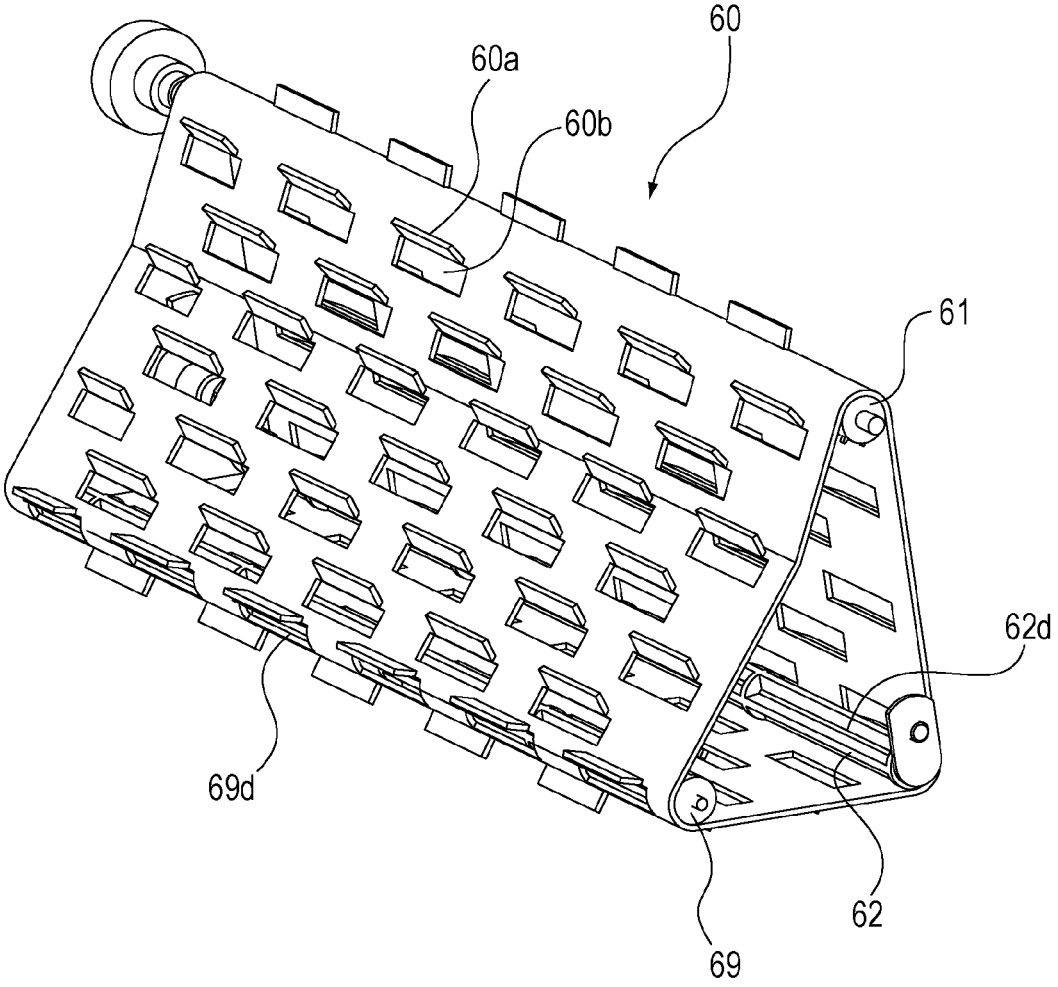
FIG. 4 is another perspective view of the toner conveying belt according to the first embodiment.

FIGS. 3 and 4 are detailed perspective views of the developer conveying belt 60. The fin portions 60*a* are arranged in the axial direction of the driving roller 61 and driven rollers 62 and 69 and in the conveying direction of the developer conveying belt 60. Specifically, the developer conveying belt 60 has 18 to 20 rows of fin portions 60*a* in the conveying direction, with each row having 5 or 6 fin portions 60*a* in the axial direction. The fin portions 60*a* in adjacent rows are arranged not to overlap each other. The fin portions 60*a* are rectangular in shape. This is to maximize the amount of toner accumulated on the fin portions 60*a*.

The fin portions 60*a* each have an opening 60*b*, as they are formed by pressing a resin sheet. The openings 60*b* are slightly greater in size than the fin portions 60*a*. The fin portions 60*a* are bent for conveying toner.

With the configuration described above, the driving torque of the developer conveying belt 60 can be made smaller than that in the case where each row has about three or four fin portions 60*a* in the axial direction. If each row has ten or more fin portions 60*a* in the axial direction, the stiffness of the developer conveying belt 60 is lowered due to the resulting increase in the space of the openings 60*b*. It is thus desirable that the number of fin portions 60*a* in each row be about five to ten in the axial direction.

In the present embodiment, the developer conveying belt 60 of endless shape is formed by pressing a single resin sheet into a predetermined shape and welding the end portions of the resin sheet to each other. Alternatively, the developer conveying belt 60 may be formed by a plurality of resin sheets in the axial direction.

A toner conveying unit for supplying toner from the container 28*a* to the developing chamber 28*b* will be described in detail with reference to FIG. 1.

As illustrated in FIG. 1, the developing device 4 has the developing chamber 28*b* and the container 28*a*. The developing chamber 28*b* contains the developing roller 21, the toner supply roller 30, and the developing blade 31. The container 28*a* is disposed below the developing chamber 28*b* and contains the toner T to be supplied to the developing chamber 28*b*. The developing chamber 28*b* and the container 28*a* have the supply opening 28*e* therebetween for supplying toner from the container 28*a* to the developing chamber 28*b*.

In the container 28*a*, the developer conveying belt 60 is supported by the driving roller 61 and the driven rollers 62 and 69 such that it can run in the direction of arrow P.

As the developer conveying belt 60 runs, the fin portions 60*a* convey toner in the container 28*a* to the developing chamber 28*b* while allowing their end portions to slide and rub against the inner wall of the developing frame 28 and the lid member 50. The toner conveyed by the fin portions 60*a* moves upward while being in contact with the lid member 50. The fin portions 60*a* can convey a large amount of toner because they are set to be inclined toward the upstream side in the belt running direction (direction of arrow P). This state of the fin portions 60*a* is maintained while the fin portions 60*a* are in contact with the lid member 50, that is, during movement of the fin portions 60*a* from the vicinity of the driven roller 62 to the vicinity of the driving roller 61. Therefore, toner held between adjacent fin portions 60*a* at the lower end of the container 28*a* is conveyed to the upper end of the container 28*a* as the developer conveying belt 60 runs.

When the toner reaches the upper end of the container 28*a*, the contact between the lid member 50 and the fin portions 60*a* is released. As the developer conveying belt 60 starts to move downward in the vertical direction, the toner retained between adjacent fin portions 60*a* is delivered to the developing chamber 28*b*. When the amount of toner in the developing chamber 28*b* exceeds the capacity of the developing chamber 28*b*, the toner is returned back through the supply opening 28*e* to the container 28*a*. The openings 60*b* in the developer conveying belt 60 allow the toner to drop therethrough.

As described above, the driving roller 61 and the driven rollers 62 and 69 over which the developer conveying belt 60 is stretched have the lightening portions 61*d*, 62*d*, and 69*d*. Thus, toner caught between the developer conveying belt 60 and the driving roller 61 and driven rollers 62 and 69 can be temporarily dropped into the lightening portions 61*d*, 62*d*, and 69*d*, and then dropped through the openings 60*b* into the container 28*a*. This is possible because, as illustrated in FIGS. 3 and 4, the openings 60*b* of the developer conveying belt 60 coincide with the corresponding lightening portions 61*d*, 62*d*, and 69*d* of the rollers 61, 62, and 69 in the longitudinal direction (axial direction). It is thus possible to reduce an increase in frictional resistance of each roller caused by toner caught between the developer conveying belt 60 and the rollers 61, 62, and 69.

As described above, the developer conveying belt is in contact with the contact portion 28*c* of the developing frame 28 below the driving roller 61 in the vertical direction. Thus, toner conveyed by the fin portions 60*a* can be efficiently delivered to the developing chamber 28*b*. Without the contact portion 28*c*, the conveyed toner may be partly brought back to the container 28*a*. On the other hand, with the contact portion 28*c*, the fin portions 60*a* are folded by the contact portion 28*c* and this facilitates delivery of toner to the developing chamber 28*b*.

As described above, the present embodiment can provide a developing device and a process cartridge capable of stably supplying toner to the developing chamber 28*b*.

Second Embodiment

A color electrophotographic image forming apparatus (hereinafter referred to as an image forming apparatus) and a process cartridge (hereinafter referred to as a cartridge) according to a second embodiment will now be described.

Figure 5:
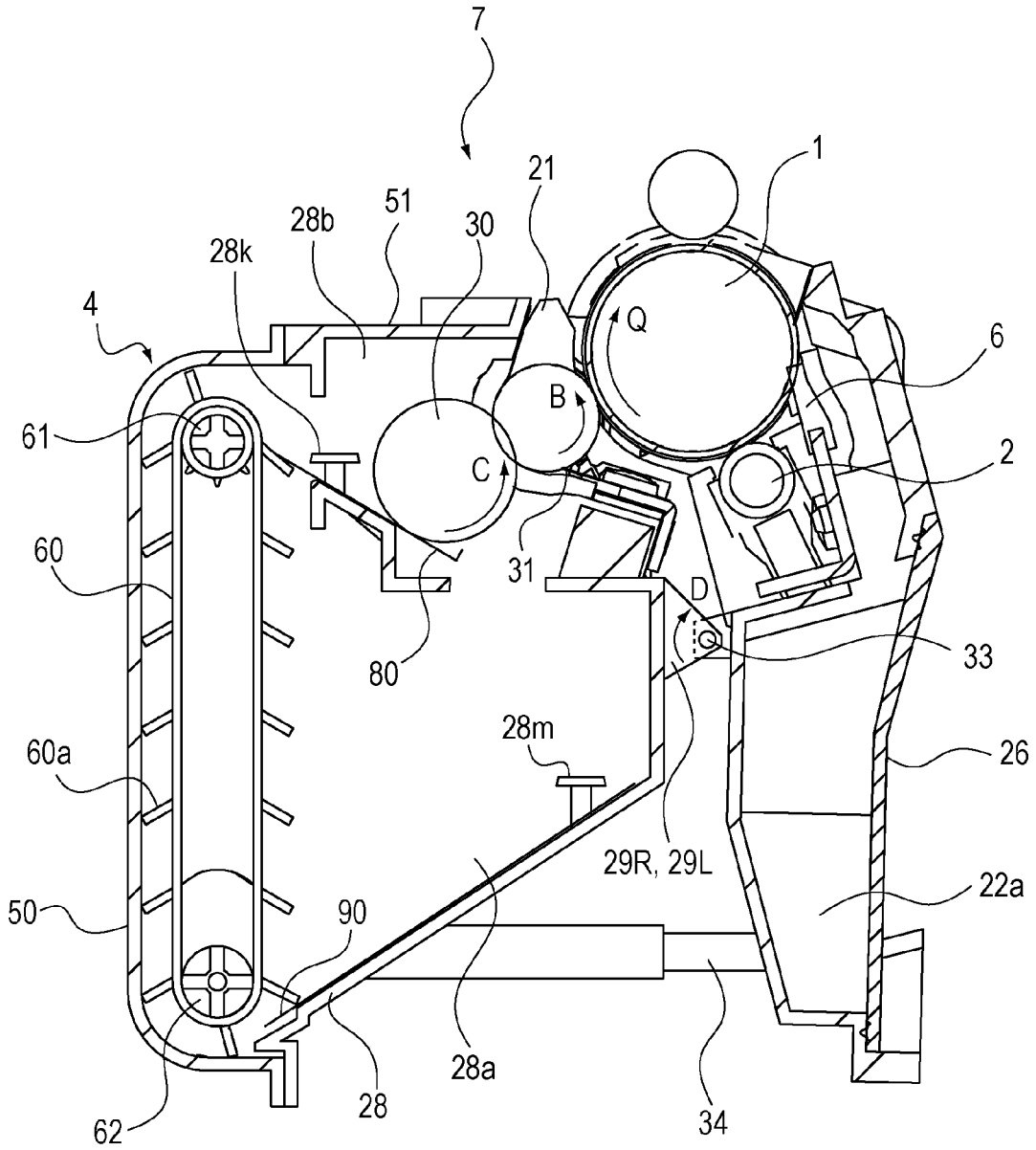
FIG. 5 is a cross-sectional view of a cartridge according to a second embodiment.
Figure 6:
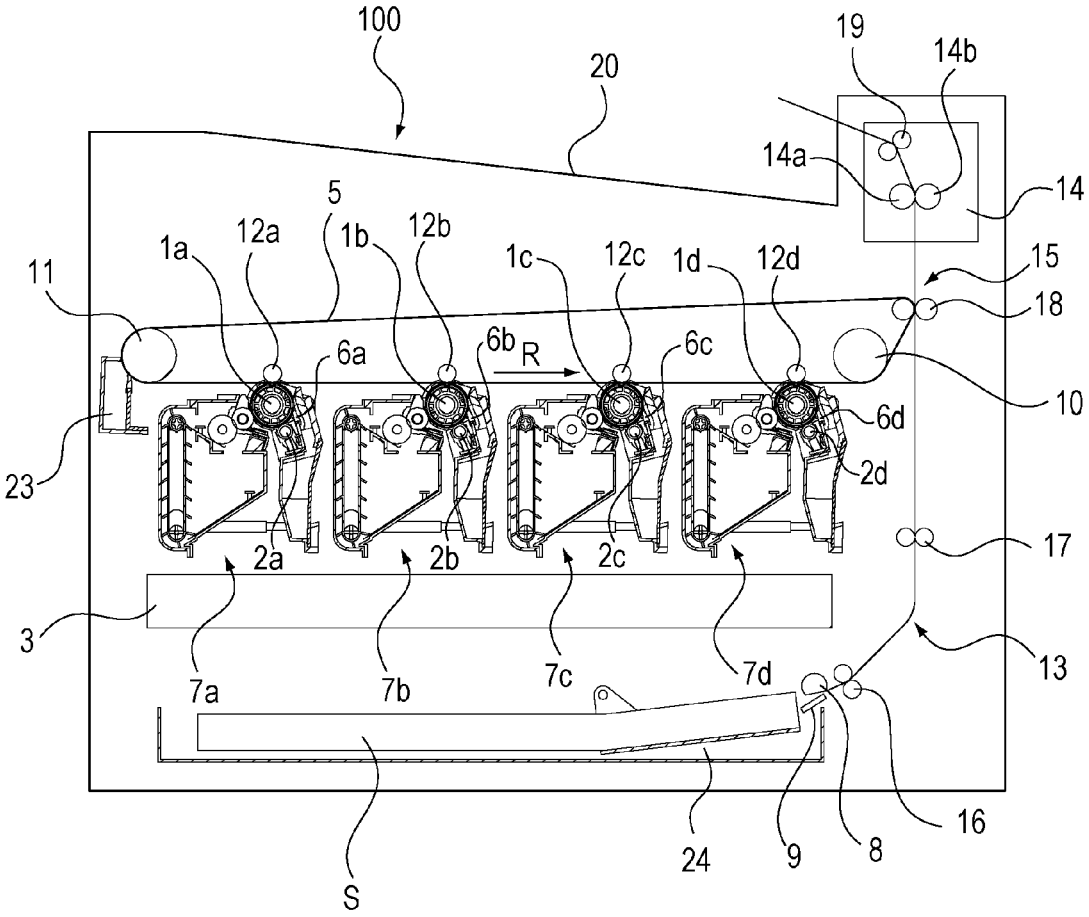
FIG. 6 is a cross-sectional view of a color electrophotographic image forming apparatus according to the second embodiment.

A general configuration of the image forming apparatus and a configuration of the cartridge are the same as those in the first embodiment, except for the detailed configuration of the developing device. Therefore, components having the same functions as those in the first embodiment are denoted by the same reference numerals as in FIGS. 5 and 6, and their description will be omitted. FIG. 5 is a principal cross-sectional view of the cartridge 7 containing toner T according to the second embodiment. FIG. 6 is a principal cross-sectional view of the image forming apparatus 100 according to the second embodiment.

(Detailed Configuration of Developing Device)

A detailed configuration of a developing device according to the present embodiment will now be described. In the present embodiment, the developing device 4 uses the developer conveying belt 60, a toner conveying sheet member 80 in the developing chamber 28*b*, and a toner drop sheet member 90 in the container 28*a* as a toner conveying unit. The configuration of the toner conveying sheet member 80, toner drop sheet member 90, and developer conveying belt 60 of the developing device 4 according to the present embodiment will be described in order of assembly, with reference to FIGS. 7, 8, and 9A and 9B. FIGS. 7, 8, and 9A and 9B illustrate assembly of the developing device 4. For ease of explanation, only parts related to the present invention will be described and the description of other parts will be omitted.

Figure 7:
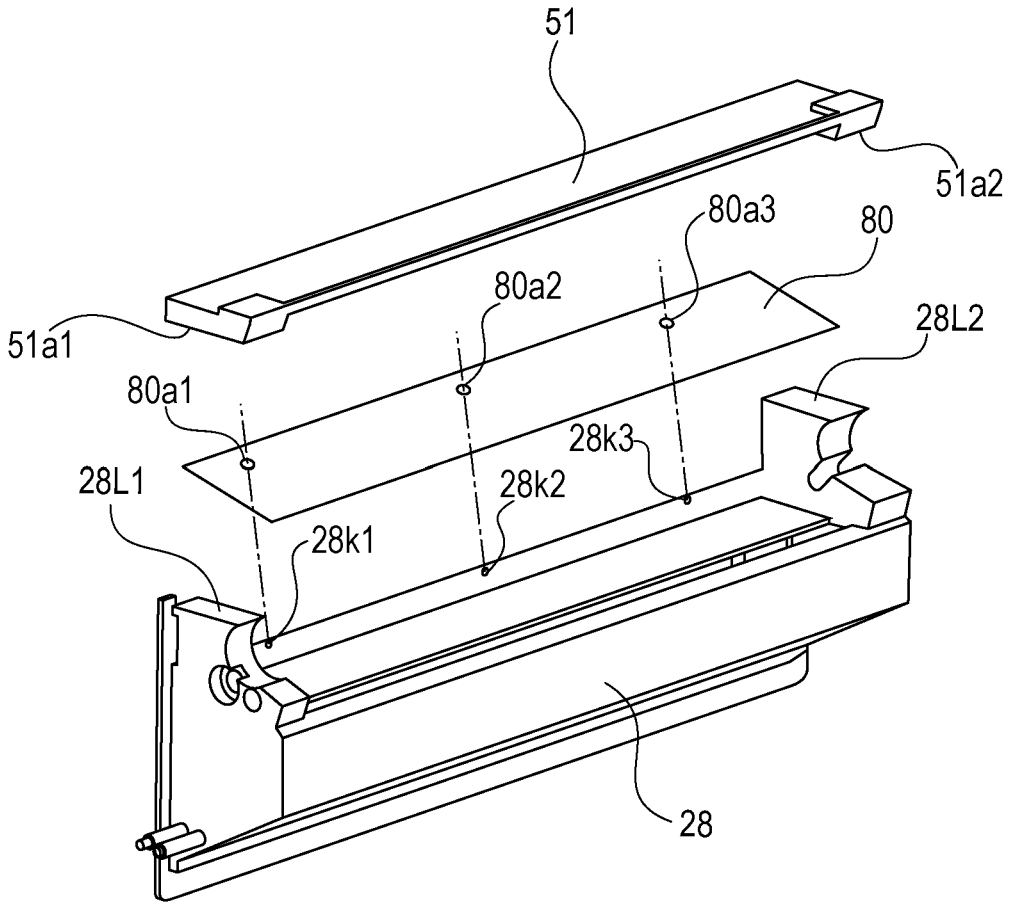
FIG. 7 illustrates assembly of a toner conveying sheet member and a mandible-like member according to the second embodiment.

FIG. 7 is an assembly diagram illustrating how the toner conveying sheet member 80 and the mandible-like member 51 are assembled to the developing frame 28. As illustrated in FIG. 7, the toner conveying sheet member 80 has holes 80*a*1, 80*a*2, and 80*a*3, into which bosses 28*k*1, 28*k*2, and 28*k*3, respectively, of the developing frame 28 are inserted. Then, the bosses 28*k*1, 28*k*2, and 28*k*3 are thermally caulked at their ends to retain the toner conveying sheet member 80 (see FIG. 5). After assembly of the toner conveying sheet member 80, faces 51*a*1 and 51*a*2 of the mandible-like member 51 are welded or bonded to faces 28L1 and 28L2, respectively, of the developing frame 28, so that the mandible-like member 51 combines with the developing frame 28 to form a single unit.

Figure 8:
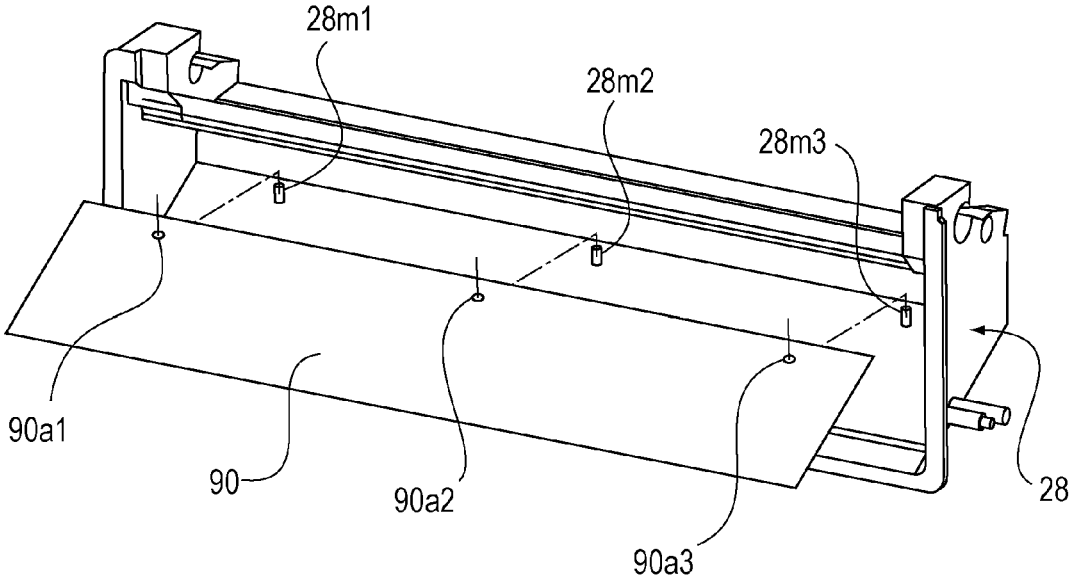
FIG. 8 illustrates assembly of a toner drop sheet member according to the second embodiment.

FIG. 8 is an assembly diagram illustrating how the toner drop sheet member 90 is assembled in the developing frame 28. As illustrated in FIG. 8, the toner drop sheet member 90 has holes 90*a*1, 90*a*2, and 90*a*3, into which bosses 28*m*1, 28*m*2, and 28*m*3, respectively, of the developing frame 28 are inserted. Then, the bosses 28*m*1, 28*m*2, and 28*m*3 are thermally caulked at their ends to retain the toner drop sheet member 90 (see FIG. 5). For example, a resin sheet made of polyethylene terephthalate (PET) resin, polycarbonate (PC) resin, or polyphenylene sulfide (PPS) resin may be used to form the toner conveying sheet member 80 and the toner drop sheet member 90.

Figure 9A:
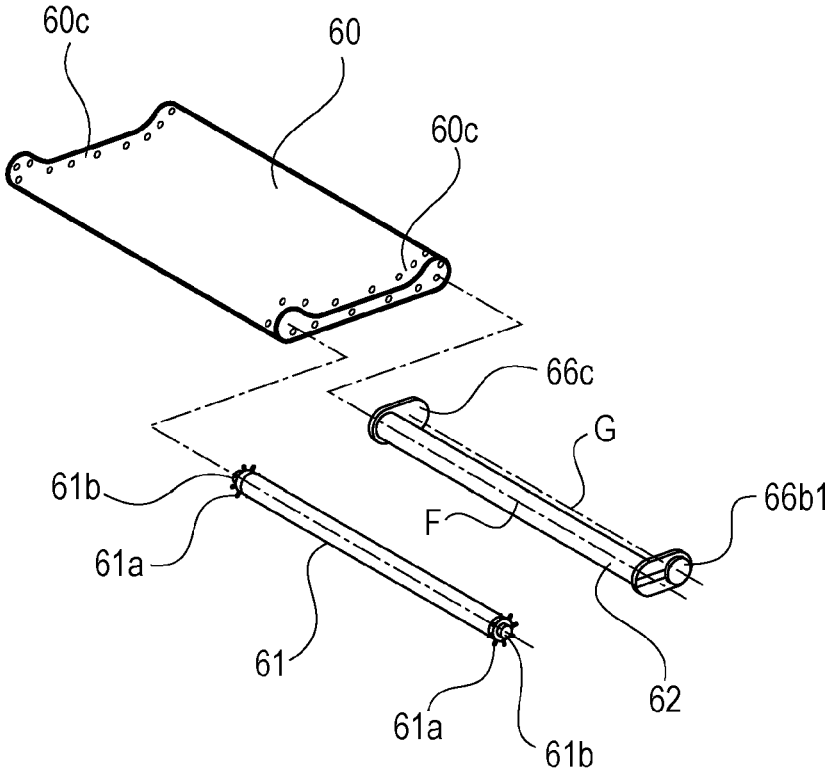
FIGS. 9A and 9B illustrate assembly of a driving roller, a driven roller, and a developer conveying belt according to an embodiment.
Figure 9B:
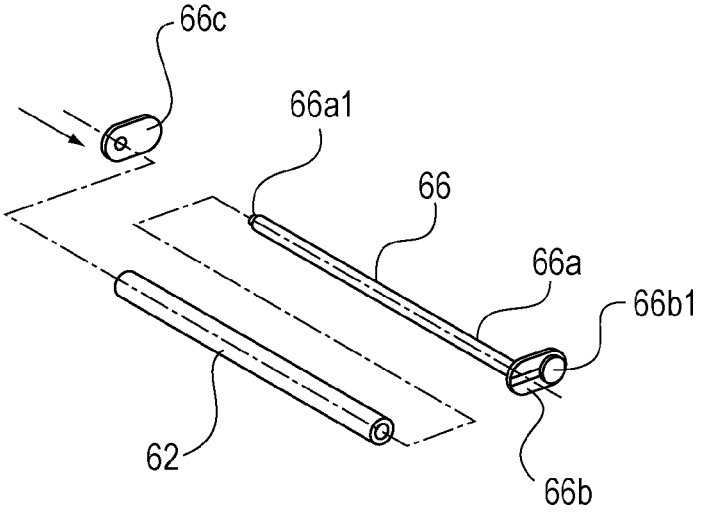
Figure 10A:
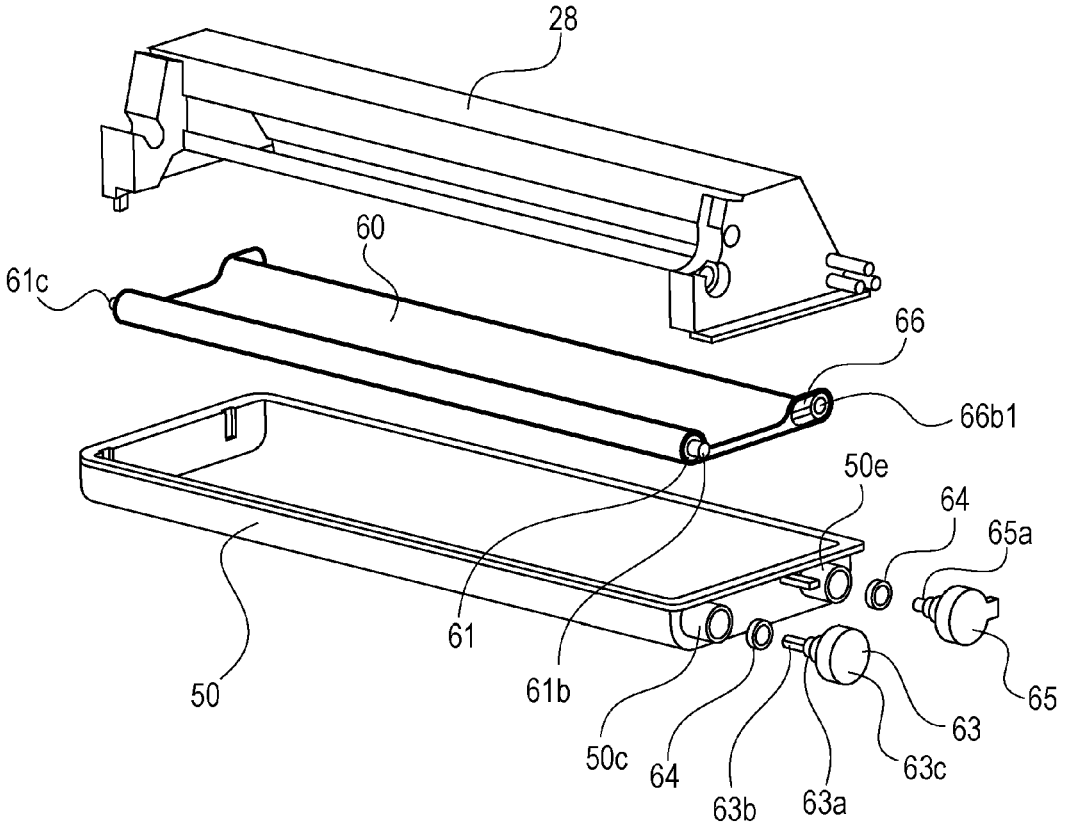
FIGS. 10A and 10B illustrate assembly of a toner conveying unit according to the second embodiment.
Figure 10B:
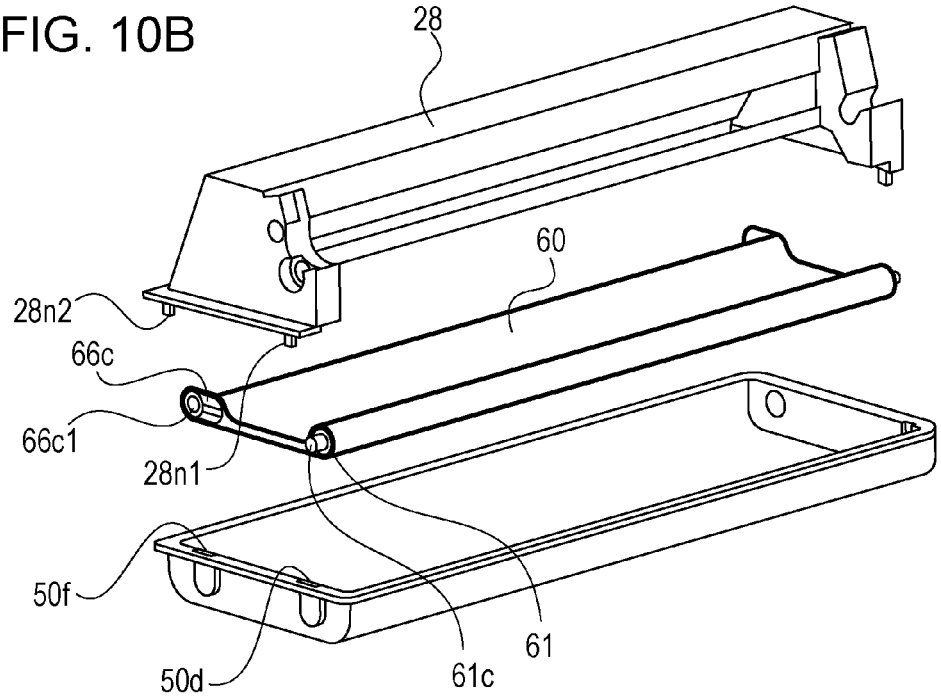
Figure 11A:
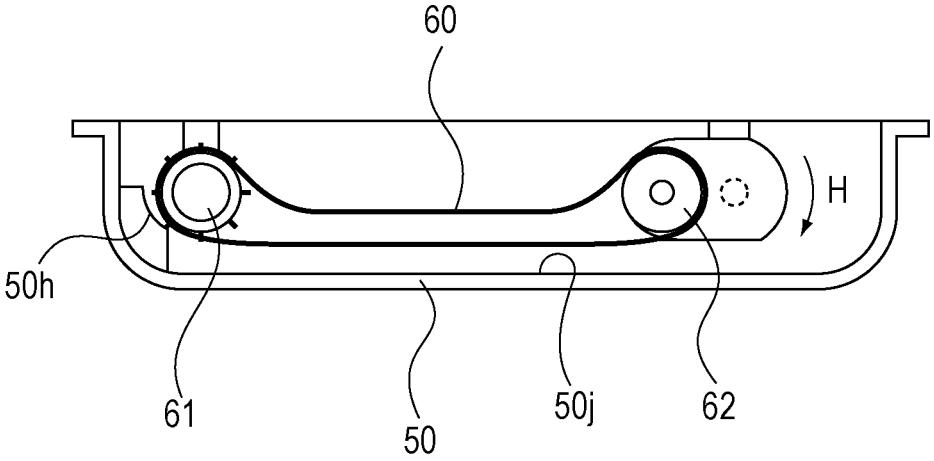
FIGS. 11A and 11B are cross-sectional views illustrating a loosened state and a stretched state, respectively, of a developer conveying belt according to the second embodiment.
Figure 11B:
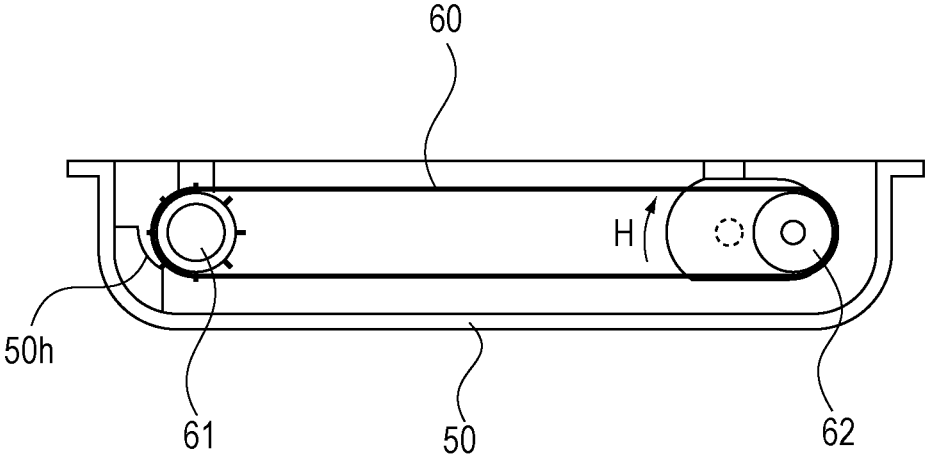
Figure 12A:
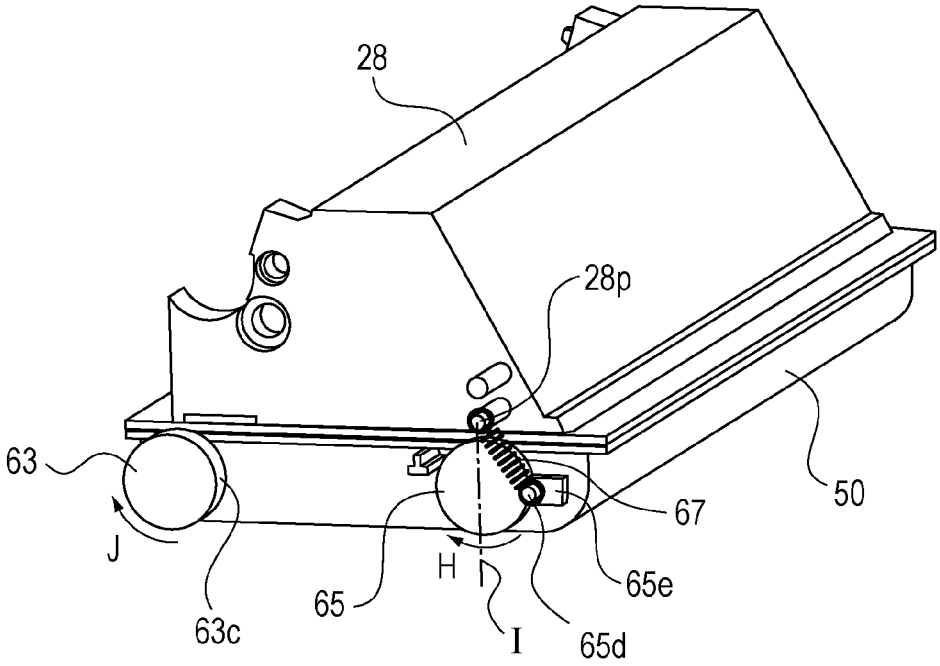
FIGS. 12A and 12B are perspective views illustrating a securing unit for securing the driven roller according to the second embodiment.
Figure 12B:
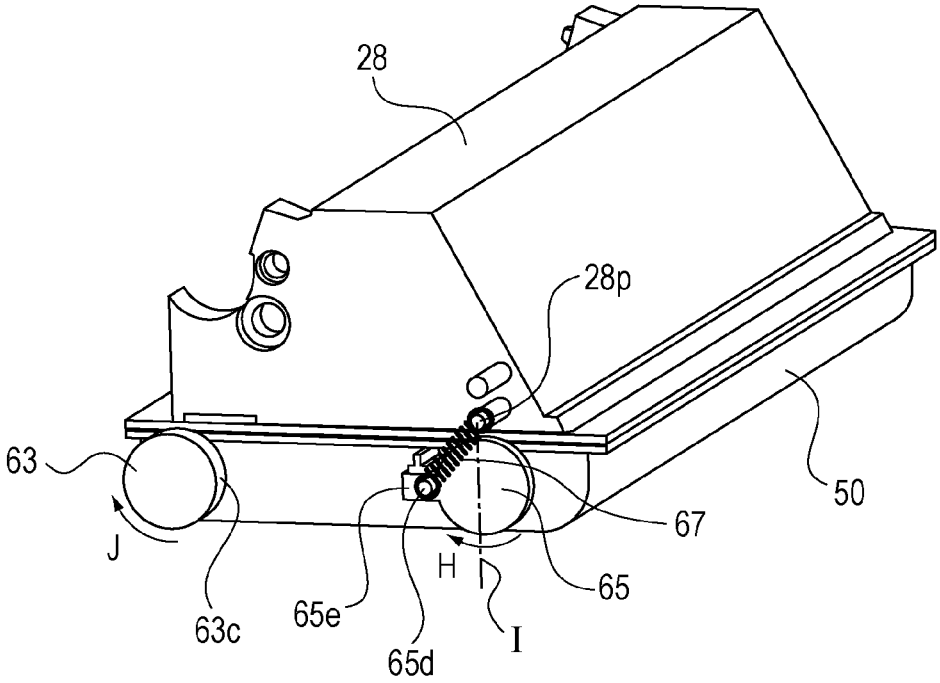

FIGS. 9A and 9B are assembly diagrams illustrating how a driving roller and a driven roller are assembled to a developer conveying belt. FIGS. 10A and 10B are assembly diagrams illustrating how a toner conveying unit formed, for example, by the developer conveying belt is assembled in a container. FIG. 11A is a cross-sectional view illustrating a loosened state of the developer conveying belt. FIG. 11B is a cross-sectional view illustrating a stretched state of the developer conveying belt. FIGS. 12A and 12B are perspective views illustrating a securing unit for securing the driven roller.

First, as illustrated in FIG. 9A, the driving roller 61 and the driven roller 62 are inserted into the inner space of the developer conveying belt 60 of endless type. The developer conveying belt 60 has the fin portions 60*a* integral therewith for conveying and stirring toner (see FIG. 5). The fin portions 60*a* are not shown in FIGS. 9A and 9B to FIGS. 11A and 11B. The description of the fin portions 60*a* will be omitted here, as the more detailed description will be given later on. For example, a resin sheet made of polyethylene terephthalate (PET) resin, polycarbonate (PC) resin, or polyphenylene sulfide (PPS) resin may be used to form the developer conveying belt 60. The driving roller 61 has sprockets 61*a* at both ends thereof. The driving force of the driving roller 61 is transmitted to the developer conveying belt 60 by engaging the sprockets 61*a* in holes 60*c* at both ends of the developer conveying belt 60. As illustrated in FIG. 9B, the driven roller 62 is rotatably supported by a support member 66, whose shaft portion 66*a* is inserted in the driven roller 62. By securing a shaft end portion 66*c* to a protrusion 66*a*1, the movement of the driven roller 62 in the longitudinal direction is regulated by shaft end portions 66*b* and 66*c*.

The assembly of the driving roller 61 will now be described. As illustrated in FIG. 10A, one end of the driving roller 61 in the longitudinal direction is rotatably supported by a driving roller shaft 63, which passes through a shaft hole 50*c*, from outside the lid member 50. The coupling of the driving roller 61 and the driving roller shaft 63 is made by engaging a two-way shaft 63*a* of the driving roller shaft 63 in a two-way hole 61*b* at the one end of the driving roller 61, and engaging a retaining nail 63*b* of the driving roller shaft 63 with a securing portion (not shown) for securing the driving roller 61. A seal member 64 is provided between the driving roller shaft 63 and the shaft hole 50*c*. The seal member 64 prevents toner from leaking through the shaft hole 50*c* of the lid member 50.

As illustrated in FIG. 10B, the driving roller 61 has an end shaft 61*c* at the other end thereof in the longitudinal direction. The end shaft 61*c* is fitted into a groove portion 50*d* of the lid member 50 and retained by a retaining portion 28*n*1 of the developing frame 28, whereby the driving roller 61 is rotatably supported. A bottom face (not shown) of the groove portion 50*d* rotatably supporting the end shaft 61*c* is in the shape of a U-shaped or V-shaped bearing. The driving roller shaft 63 has a gear portion 63*c* integral therewith. The driving roller shaft 63 transmits, to the driving roller 61, a driving force transmitted from a driving-force transmitting unit (not shown) having a gear train.

The assembly of the driven roller 62 will now be described. As illustrated in FIG. 9B, the driven roller 62 is rotatably supported by the support member 66. As illustrated in FIG. 10A, one end of the support member 66 in the longitudinal direction is rotatably supported by a driven roller shaft 65, which passes through a shaft hole 50*e*, from outside the lid member 50. The coupling of the support member 66 and the driven roller shaft 65 is made by engaging a two-way shaft 65*a* of the driven roller shaft 65 in a two-way hole 66*b*1 at the one end of the support member 66, and engaging a retaining nail (not shown) of the driven roller shaft 65 with a securing portion (not shown) for securing the support member 66. A seal member 64 is provided between the driven roller shaft 65 and the shaft hole 50*e*. The seal member 64 prevents toner from leaking through the shaft hole 50*e* of the lid member 50.

As illustrated in FIG. 10B, the other end of the support member 66 in the longitudinal direction is rotatably supported by an end shaft 66*c*1 in the shaft end portion 66*c* of the support member 66. The end shaft 66*c*1 is fitted into a groove portion 50*f* of the lid member 50 and retained by a retaining portion 28*n*2 of the developing frame 28, whereby the support member 66 is rotatably supported. A bottom face (not shown) of the groove portion 50*f* rotatably supporting the end shaft 66*c*1 is in the shape of a U-shaped or V-shaped bearing.

As illustrated in FIG. 9A, an axial line F of the shaft portion 66*a* (see FIG. 9B) of the support member 66 supporting the driven roller 62 is displaced from an axial line G connecting the center of the two-way hole 66*b*1 in the shaft end portion 66*b* of the support member 66 and the center of the end shaft 66*c*1 (see FIG. 10B) in the shaft end portion 66*c* of the support member 66. Thus, rotating the driven roller shaft 65 (see FIG. 10A) allows the driven roller 62 to swing about the axial line G.

A further description will be given with reference to the cross-sectional views of FIGS. 11A and 11B. FIG. 11A is a cross-sectional view illustrating a loosened state of the developer conveying belt 60. FIG. 11B is a cross-sectional view illustrating a stretched state of the developer conveying belt 60. When the driven roller 62 is rotated in the direction of arrow H, the driven roller 62 swings to stretch the developer conveying belt 60 between the driven roller 62 and the driving roller 61. The lid member 50 is provided with ribs 50*h*. This is to prevent the sprockets 61*a* at both ends of the driving roller 61 from being disengaged from the holes 60*c* at both ends of the developer conveying belt 60 when the developer conveying belt 60 is loosened. The ribs 50*h* are disposed near the sprockets 61*a* at both ends of the driving roller 61, and longitudinally positioned to avoid interference with the fin portions 60*a* and the openings 60*b* of the developer conveying belt 60.

FIGS. 12A and 12B are perspective views illustrating a configuration of a securing unit for securing the driven roller. FIG. 12A is a perspective view illustrating a state where the developer conveying belt 60 is biased in a loosened state. FIG. 12B is a perspective view illustrating a state where the developer conveying belt 60 is biased in a stretched state. The developing frame 28 and the lid member 50 illustrated in FIGS. 12A and 12B are joined together by welding or the like. A tension spring 67 serving as a biasing unit is stretched between a boss 65*d* of the driven roller shaft 65 and a boss 28*p* of the developing frame 28. Thus, when the developer conveying belt 60 is in a loosened state, the driven roller 62 is biased toward an inner surface 50*j* (see FIG. 11A) of the lid member 50. When the driven roller shaft 65 is rotated in the direction of arrow H, the developer conveying belt 60 is stretched by the biasing force of the tension spring 67 upon passage of the boss 65*d* of the driven roller shaft 65 over an axial line I which connects the center of the boss 28*p* of the developing frame 28 and the rotation center of the driven roller shaft 65. This configuration allows the developer conveying belt 60 to be reliably stretched, because variation in circumference caused by the tolerance of the developer conveying belt 60 can be accommodated.

Figure 13:
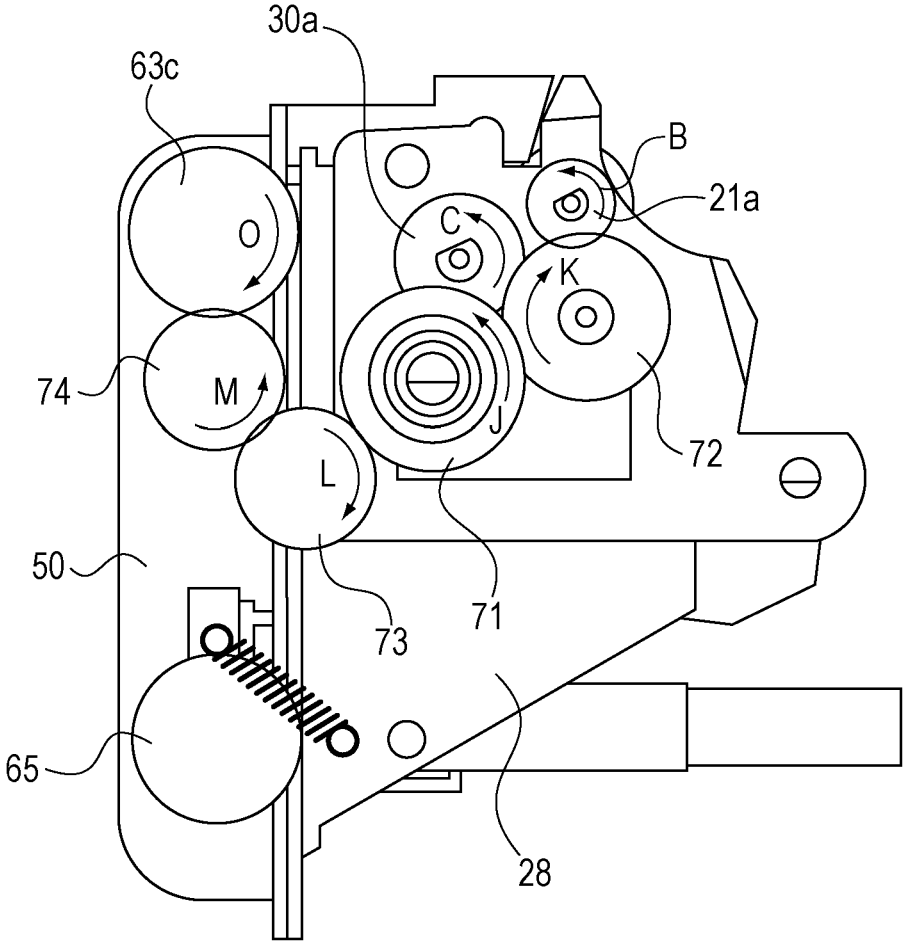
FIG. 13 illustrates a drive transmission unit for the developer conveying belt according to the second embodiment.

A drive transmission unit for the developer conveying belt 60 will now be described with reference to FIG. 13. FIG. 13 is a lateral view of the developing device 4 for illustrating the drive transmission unit for the developer conveying belt 60. A driven gear 71 at one end of the developing device 4 in the longitudinal direction engages with a driving gear (not shown) of the image forming apparatus 100, thereby transmitting the driving force of the driving motor (not shown) in the direction of arrow J. Through an idler gear 72 engaging with the driven gear 71, the driving force is transmitted to a developing roller gear 21*a* and a toner supply roller gear 30*a* in the directions of arrows B and C, respectively. Through idler gears 73 and 74 engaging with the driven gear 71, the driving force is transmitted to the gear portion 63*c* of the driving roller shaft 63 in the direction of arrow O. The drive is thus transmitted to the developing roller 21, the toner supply roller 30, and the developer conveying belt 60.

A toner conveying unit for supplying toner from the container 28*a* to the developing chamber 28*b* will now be described in detail with reference to FIGS. 14 to 16.

Figure 14:
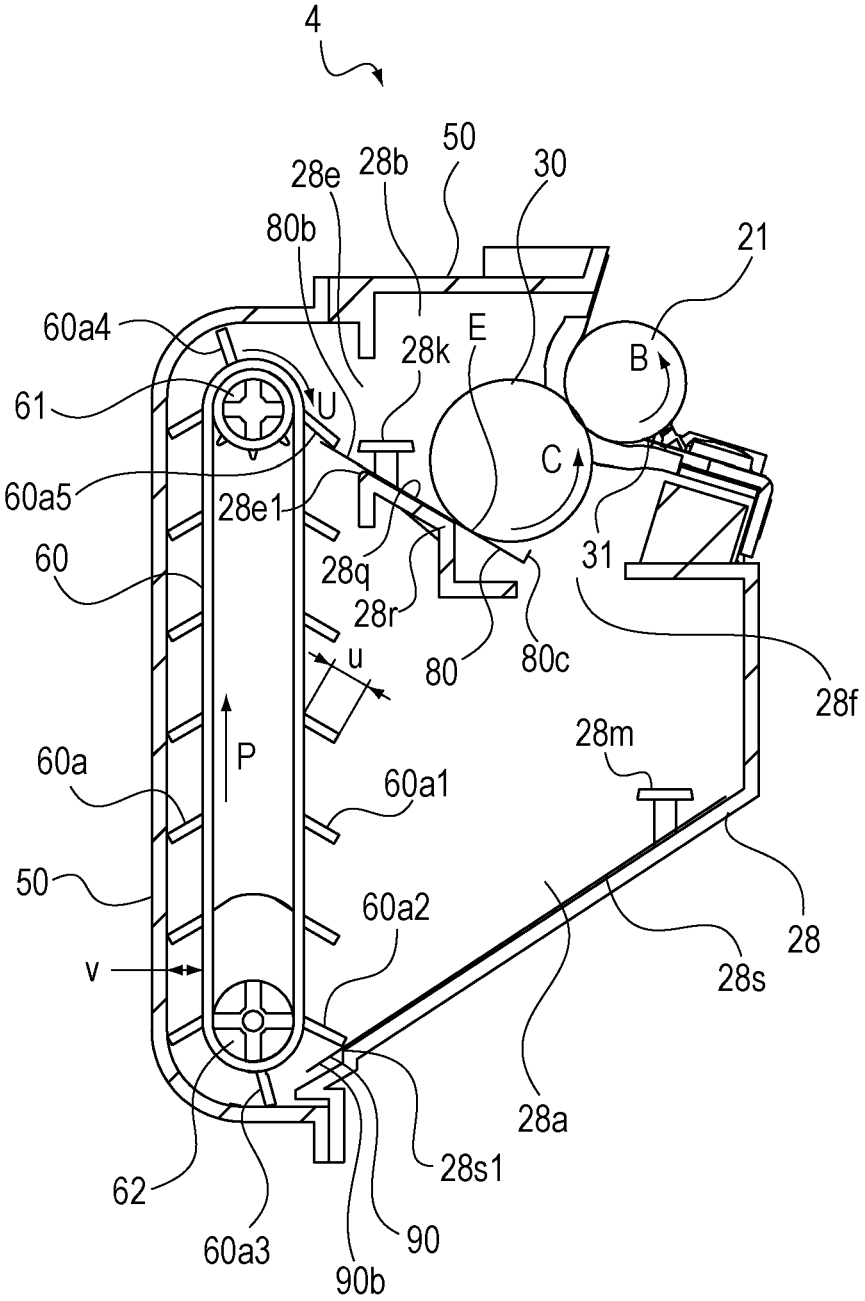
FIG. 14 illustrates a state of the developer conveying belt, toner conveying sheet member, and toner drop sheet member according to the second embodiment.

FIG. 14 illustrates a state immediately before the fin portions 60*a* of the developer conveying belt 60 are brought into contact with the toner conveying sheet member 80 and the toner drop sheet member 90. FIG. 15 illustrates a state where the fin portions 60*a* of the developer conveying belt 60 are in contact with the toner conveying sheet member 80 and the toner drop sheet member 90. FIG. 16 illustrates a state where the fin portions 60*a* of the developer conveying belt 60 are spaced from (or out of contact with) the toner conveying sheet member 80 and the toner drop sheet member 90.

As illustrated in FIG. 14, the developing device 4 has the developing chamber 28*b* and the container 28*a*. The developing chamber 28*b* contains the developing roller 21, the toner supply roller 30, and the developing blade 31. The container 28*a* is disposed below the developing chamber 28*b* and contains the toner T to be supplied to the developing chamber 28*b*. The lid member 50 attached to the developing frame 28 is provided with the developer conveying belt 60 having the fin portions 60*a*. The supply opening 28*e* for supplying toner from the container 28*a* to the developing chamber 28*b* and a discharge opening 28*f* for returning toner from the developing chamber 28*b* to the container 28*a* are provided between the developing chamber 28*b* and the container 28*a*. The discharge opening 28*f* is disposed below the supply opening 28*e* in the vertical direction. A supply-opening end face 28*e*1 on the lower side of the supply opening 28*e* is disposed above a nip E between the toner supply roller 30 and the toner conveying sheet member 80. More specifically, the toner conveying sheet member 80 is disposed below the toner supply roller 30, and the toner conveying sheet member 80 is attached to an inclined surface (inclined portion) 28*q* extending at an angle from the supply opening 28*e* (supply opening side) toward the discharge opening 28*f* (discharge opening side). An end portion 80*b*, which is one end of the toner conveying sheet member 80, is set to protrude from the supply-opening end face 28*e*1 on the lower side of the supply opening 28*e*. The other end of the toner conveying sheet member 80 protrudes from an end face 28*r* of the inclined surface 28*q*, extends beyond the nip E between the toner supply roller 30 and the toner conveying sheet member 80, and has a bent portion 80*c* above the discharge opening 28*f*. As described with reference to FIG. 7, the toner conveying sheet member is retained by inserting the bosses 28*k* of the developing frame 28 into the holes 80*a* and thermally caulking the end portions of the bosses 28*k*. Thus, the toner conveying sheet member 80 is disposed to be movable between the thermally caulked portions of the bosses 28*k* and the inclined surface 28*q* of the developing frame 28. The end portion 80*b* of the toner conveying sheet member 80 is disposed to be in contact with the fin portions 60*a* of the developer conveying belt 60.

As described above, the toner drop sheet member 90 is disposed in the container 28*a*. The toner drop sheet member 90 is attached to a bottom surface (inclined portion) 28*s* located at the bottom of the container 28*a* and inclined in the direction from the discharge opening 28*f* (discharge opening side) toward the supply opening 28*e* (supply opening side). As described with reference to FIG. 8, the toner drop sheet member 90 has the holes 90*a*, into which the bosses 28*m* of the developing frame 28 are inserted. The toner drop sheet member 90 is retained by thermally caulking the end portions of the bosses 28*k*. Thus, the toner drop sheet member 90 is disposed to be movable between the thermally caulked portions of the bosses 28*m* and the bottom surface 28*s* of the developing frame 28. An end portion 90*b*, which is a lower end of the toner drop sheet member 90 in the direction of inclination, protrudes from an end portion 28*s*1 of the bottom surface 28*s* of the developing frame 28. The end portion 90*b* of the toner drop sheet member 90 is disposed to be in contact with the fin portions 60*a* of the developer conveying belt 60. Thus, when the developer conveying belt 60 runs, the fin portions 60*a* are brought into and out of contact with the end portion 90*b* of the toner drop sheet member 90.

In the container 28*a*, the developer conveying belt 60 is supported by the driving roller 61 and the driven roller 62 such that it can run in the direction of arrow P. The developer conveying belt 60 has the fin portions 60*a* extending substantially horizontally in the longitudinal direction of the developing device 4. A width u of the fin portions 60*a* on the short side is set to be longer than a width v defined by the developer conveying belt 60 and the inner surface 50*j* (see FIG. 11A) of the lid member 50.

The fin portions 60*a* are set to be inclined with respect to the belt running direction or the direction of arrow P (as in the state of the fin portion 60*a*1). When the developer conveying belt 60 moves from this state, the fin portions 60*a* are brought into contact with the toner drop sheet member 90 in the vicinity of the driven roller 62 at the lower end of the container 28*a*, and inclined in the direction opposite the direction of travel (as in the state of the fin portion 60*a*2).

When the developer conveying belt 60 moves further, the fin portions 60*a* make a transition from the state of being in contact with the toner drop sheet member 90 to the state of being in contact with the lid member 50 while maintaining the inclination in the direction opposite the direction of travel (as in the state of the fin portion 60*a*3).

This state of the fin portions 60*a* is maintained while the fin portions 60*a* are in contact with the lid member 50, that is, during movement of the fin portions 60*a* from the vicinity of the driven roller 62 to the vicinity of the driving roller 61. Thus, toner held between adjacent fin portions 60*a* at the lower end of the container 28*a* is conveyed to the upper end of the container 28*a* as the developer conveying belt 60 runs.

When the toner is conveyed to the upper end of the container 28*a*, the contact between the fin portions 60*a* and the lid member 50 is released. Then, the inclination of the fin portions 60*a* maintained in the direction opposite the direction of travel of the developer conveying belt 60 is released and returned to the inclination in the direction of travel (as in the state of the fin portion 60*a*1). By the elastic force generated at the release of the inclination, toner on the fin portions 60*a* (in the state of the fin portion 60*a*4) is delivered onto the toner conveying sheet member 80.

The angle of inclination of the fin portions 60*a* in a natural state where the fin portions 60*a* are not in contact with the developing frame 28 (i.e., inclination of the fin portion 60*a*1) is set to be greater than the angle of repose of the developer. Therefore, after the contact between the fin portions 60*a* and the lid member 50 is released, toner on the fin portions 60*a* is supplied to the developing chamber 28*b* without remaining on the fin portions 60*a*.

Figure 15:
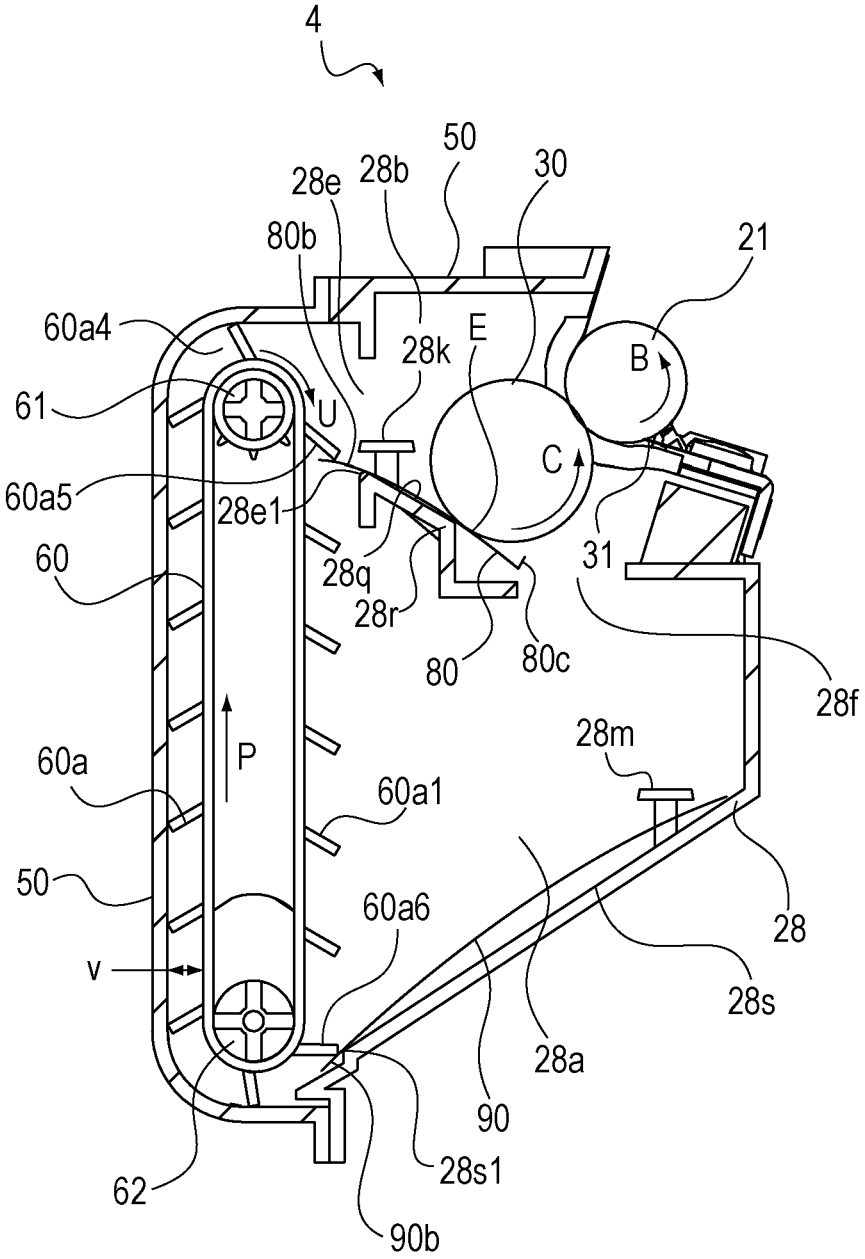
FIG. 15 illustrates another state of the developer conveying belt, toner conveying sheet member, and toner drop sheet member according to the second embodiment.

FIG. 15 illustrates a state reached by moving the developer conveying belt 60 of FIG. 14 in the direction of arrow P. The fin portions 60*a* of the developer conveying belt 60 (in the state of fin portion 60*a*5) are brought into contact with the end portion 80*b* of the toner conveying sheet member 80 to cause the toner conveying sheet member 80 to warp. In the container 28*a*, the fin portions 60*a* of the developer conveying belt 60 (in the state of the fin portion 60*a*6) are brought into contact with the end portion 90*b* of the toner drop sheet member 90 to cause the toner drop sheet member 90 to warp.

Figure 16:
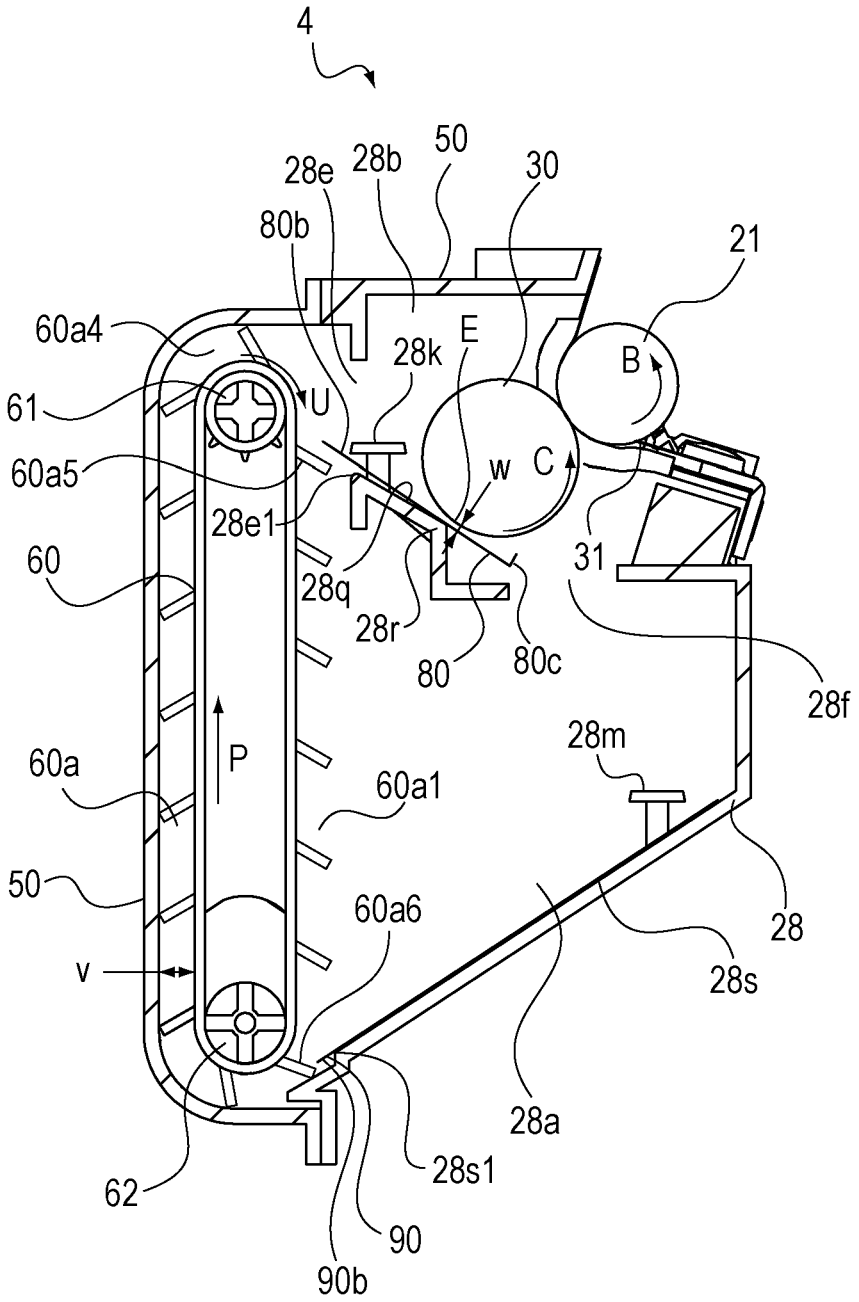
FIG. 16 illustrates another state of the developer conveying belt, toner conveying sheet member, and toner drop sheet member according to the second embodiment.

FIG. 16 illustrates a state reached by moving the developer conveying belt 60 of FIG. 15 in the direction of arrow P. The fin portions 60*a* of the developer conveying belt 60 are spaced from (or out of contact with) the end portion 80*b* of the toner conveying sheet member 80. The toner conveying sheet member 80 has elasticity. By being released from the warped state, the toner conveying sheet member 80 vibrates by elastic force and conveys toner thereon toward the toner supply roller 30. The toner accumulated on the upstream side of the nip E is applied to the toner supply roller 30 at the nip E and further supplied to the developing roller 21.

By vibration transmitted through the toner conveying sheet member 80, toner conveyed from the developer conveying belt 60 onto the toner conveying sheet member 80 is reliably supplied to the toner supply roller 30. Since the angle of inclination of the inclined surface 28*q* can be set to be smaller than the angle of repose of the toner, the size of the developing chamber 28*b* in the height direction can be reduced.

When the toner conveying sheet member 80 vibrates, the nip E between the toner supply roller 30 and the toner conveying sheet member 80 is disengaged to create a small gap w. This allows excess toner to pass through the gap w to reach the downstream side of the disengaged nip E. Then, the toner is accumulated between the disengaged nip E and the bent portion 80*c* of the toner conveying sheet member 80. If the amount of toner on the upstream side of the disengaged nip E is insufficient due to the accumulation at the bent portion 80*c*, the toner accumulated at the bent portion 80*c* is applied to the toner supply roller 30. If a large amount of toner is accumulated between the disengaged nip E and the bent portion 80*c* of the toner conveying sheet member 80, the toner is returned through the discharge opening 28*f* into the container 28*a*.

The excess toner described above is toner that remains after continuous printing of low-coverage-rate images, because only a small amount of toner is developed by the developing roller 21. The excess toner does not circulate and accumulates on the downstream side of the disengaged nip E between the toner supply roller 30 and the toner conveying sheet member 80.

The fin portions 60*a* of the developer conveying belt 60 in the container 28*a* are spaced from (or out of contact with) the end portion 90*b* of the toner drop sheet member 90. By being released from the warped state, the toner drop sheet member 90 vibrates by elastic force and conveys toner thereon toward the developer conveying belt 60.

As described above, toner in the container 28*a* is conveyed while being retained in the spaces created between the fin portions 60*a* of the developer conveying belt 60 and the developing frame 28 or lid member 50. Thus, the toner is brought up from the container 28*a* to the developing chamber 28*b* in small amounts in the spaces described above, and is delivered to the toner conveying sheet member 80. The toner conveying sheet member 80 vibrates by contact with the fin portions 60*a* of the developer conveying belt 60, and conveys the toner to the nip E between the toner conveying sheet member 80 and the toner supply roller 30. The toner accumulated on the upstream side of the nip E is applied to the toner supply roller 30 at the nip E and further supplied to the developing roller 21.

Since the nip E is disengaged by vibration of the toner conveying sheet member 80, excess toner is returned through the discharge opening 28*f* to the container 28*a*. That is, only the amount required for development is supplied to the developing roller 21 and excess toner is collected in the container 28*a*. In other words, toner circulates between the container 28*a* and the developing chamber 28*b*.

In the present embodiment, as described above, when the amount of toner in the developing chamber exceeds a predetermined amount, vibration of the toner conveying sheet member creates a gap between the toner conveying sheet member and the toner supply roller, thereby allowing excess toner to be returned through the discharge opening to the container. The amount of toner in the developing chamber can thus be kept below a certain amount, and toner can be prevented from packing in the developing chamber.

In the present embodiment, it is possible to prevent toner packing in the developing chamber, and to stably supply toner to the toner supply roller. It is thus possible to provide a developing device and a process cartridge that can achieve more stable solid image density and can supply high-quality images.

Third Embodiment

A color electrophotographic image forming apparatus (hereinafter referred to as an image forming apparatus) and a process cartridge (hereinafter referred to as a cartridge) according to a third embodiment will be described.

Figure 17:
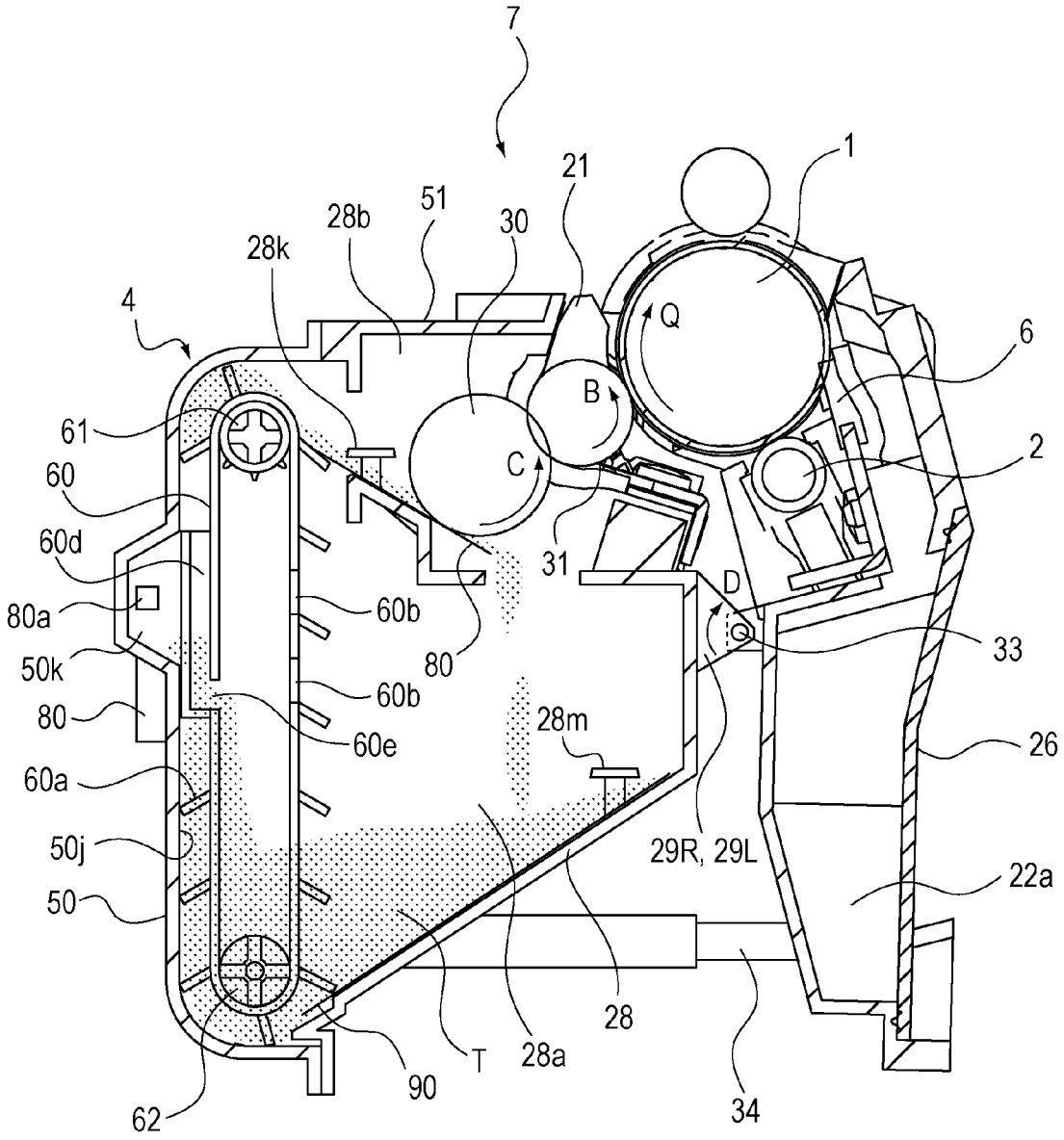
FIG. 17 is a cross-sectional view of a cartridge according to a third embodiment.
Figure 18:
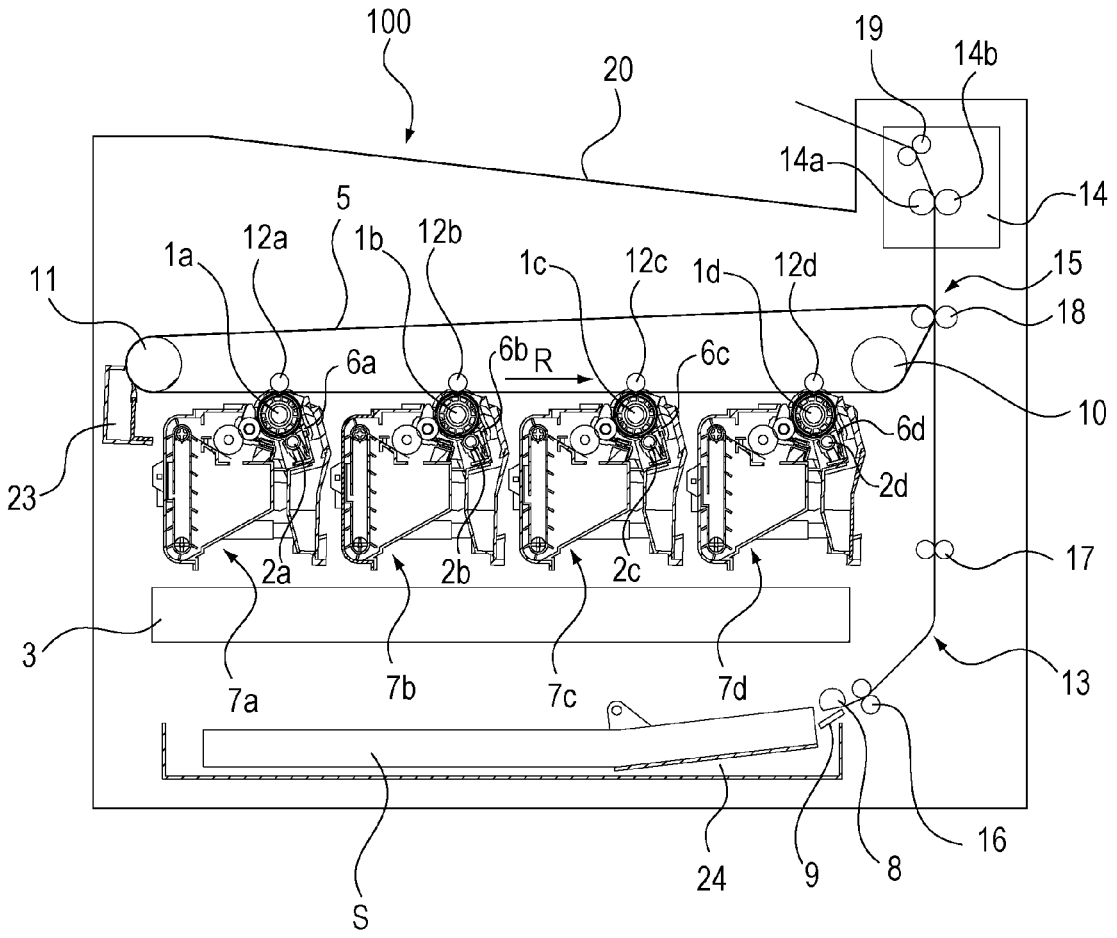
FIG. 18 is a cross-sectional view of a color electrophotographic image forming apparatus according to the third embodiment.

A general configuration of the image forming apparatus and a configuration of the cartridge are the same as those in the above-described embodiments, except for the detailed configuration of the developing device. Therefore, components having the same functions as those in the above-described embodiments are denoted by the same reference numerals as in FIGS. 17 and 18, and their description will be omitted. FIG. 17 is a principal cross-sectional view of the cartridge 7 containing toner T according to the third embodiment. FIG. 18 is a principal cross-sectional view of the image forming apparatus 100 according to the third embodiment.

(Detailed Configuration of Developing Device)

Figure 19B:
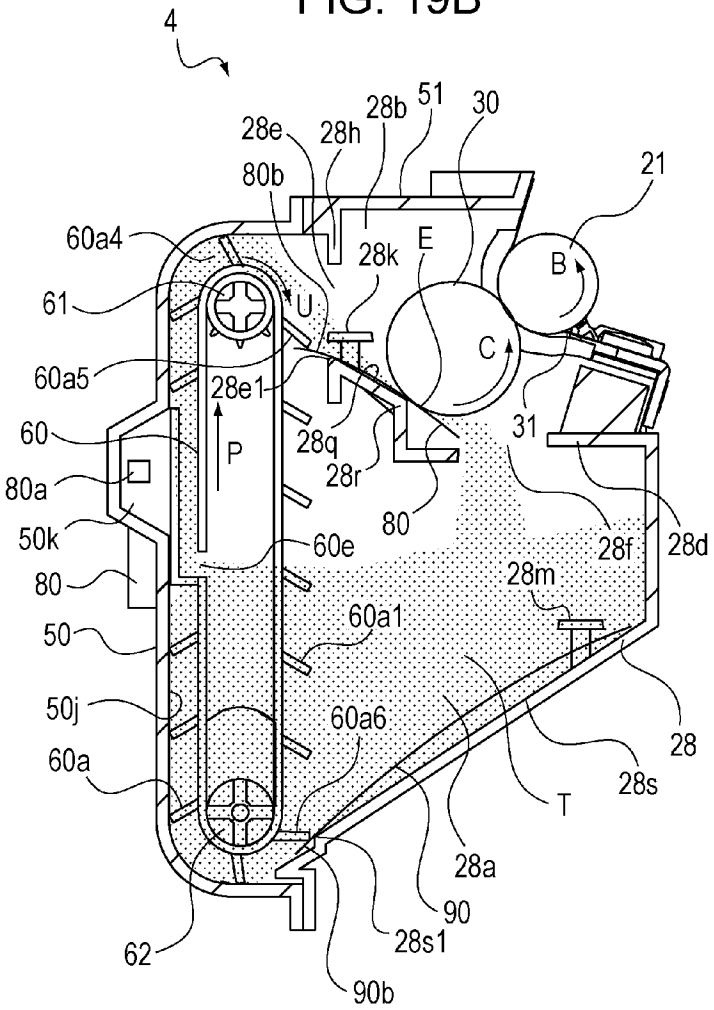
FIGS. 19A and 19B are cross-sectional views of the cartridge according to the third embodiment.

A supply unit for supplying toner from the container 28*a* to the developing chamber 28*b* in the developing device 4 will now be described in detail with reference to FIGS. 19A and 19B.

As described above, the developing device 4 is formed by the developing frame 28 forming the developing chamber 28*b* and the container 28*a*, and the lid member 50. The developing chamber 28*b* contains the developing roller 21, the toner supply roller 30, and the developing blade 31. The container 28*a* is disposed below the developing chamber 28*b*. The container 28*a* contains the toner T to be supplied to the developing chamber 28*b*, and the developer conveying belt 60. A first partition 28*h* and a second partition 28*d* are provided between the developing chamber 28*b* and the container 28*a*. The first partition 28*h* is provided with the supply opening 28*e*, and the second partition 28*d* is provided with the discharge opening 28*f*. The supply-opening end face 28*e*1 on the lower side of the supply opening 28*e* is disposed above the lowermost point of the toner supply roller 30 in the vertical direction (i.e., above the nip E between the toner supply roller 30 and the toner conveying sheet member 80). The developer conveying belt 60 is provided in the container 28*a* as a supply unit that supplies toner T to the developing chamber 28*b*. The developer conveying belt 60 is driven to run in the direction of arrow P by a driving unit (not shown).

Figure 20A:
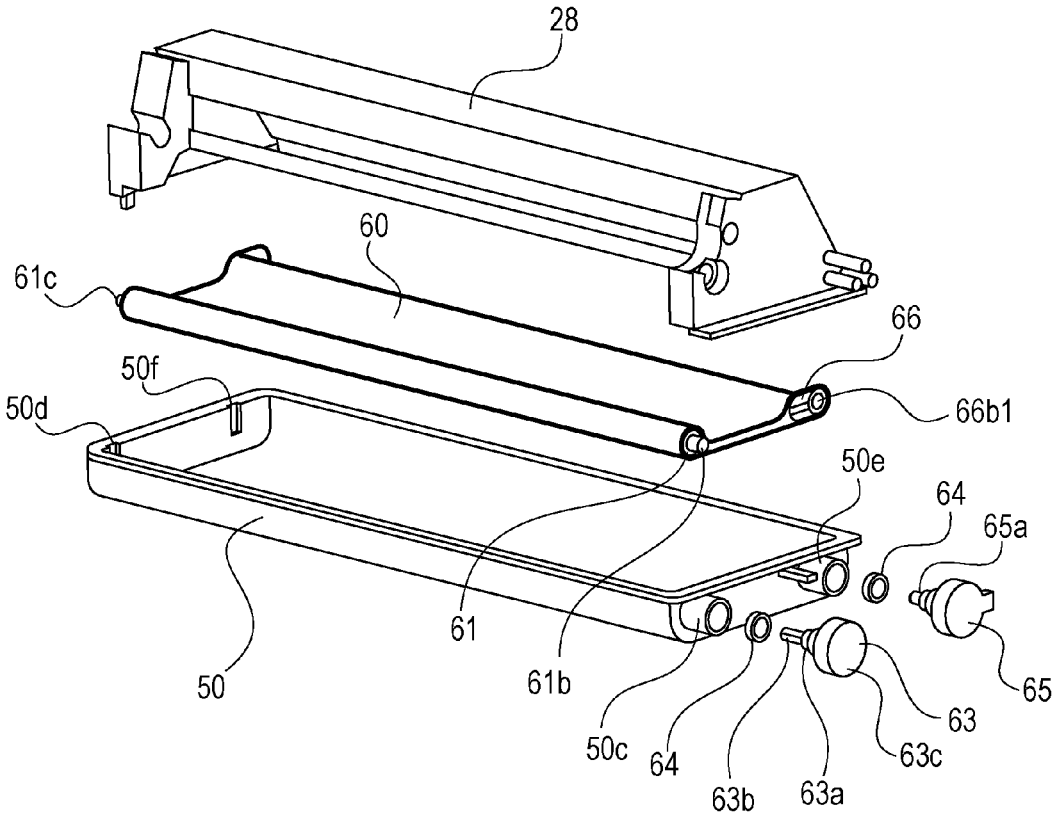
FIGS. 20A and 20B are exploded perspective views illustrating a configuration of a developing device according to the third embodiment.
Figure 20B:
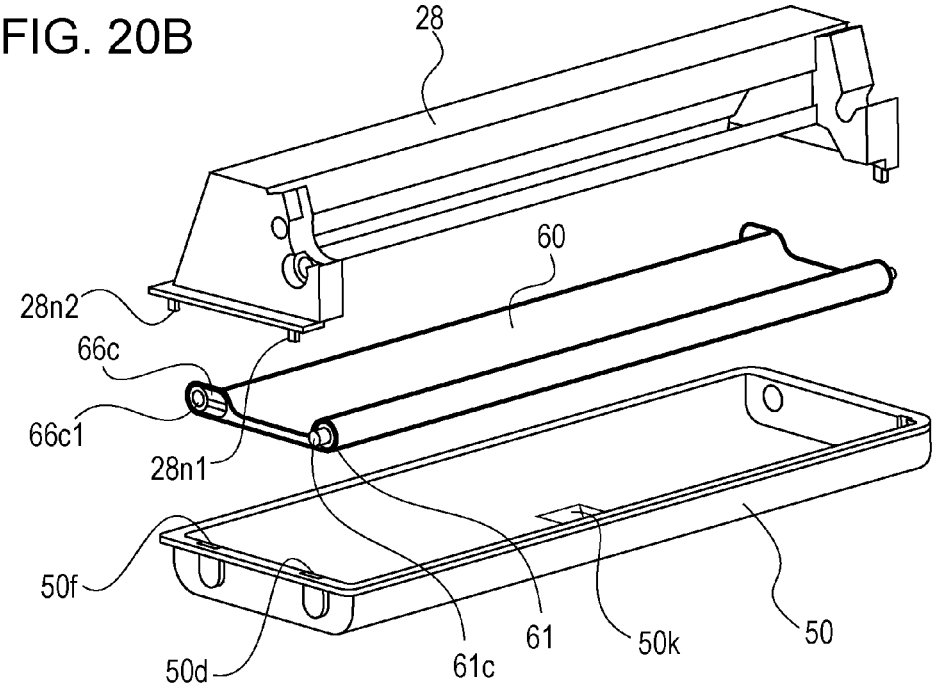
Figure 21A:
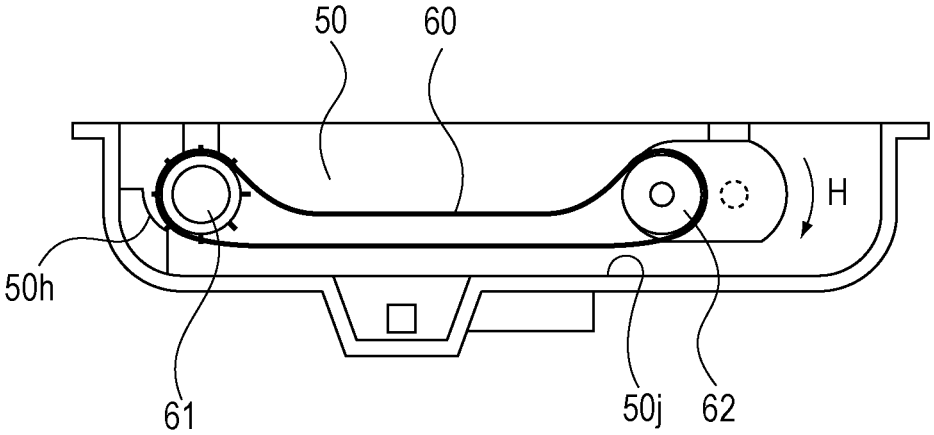
FIGS. 21A and 21B are cross-sectional views of a toner chamber illustrating a configuration of a developer conveying belt according to the third embodiment.
Figure 21B:
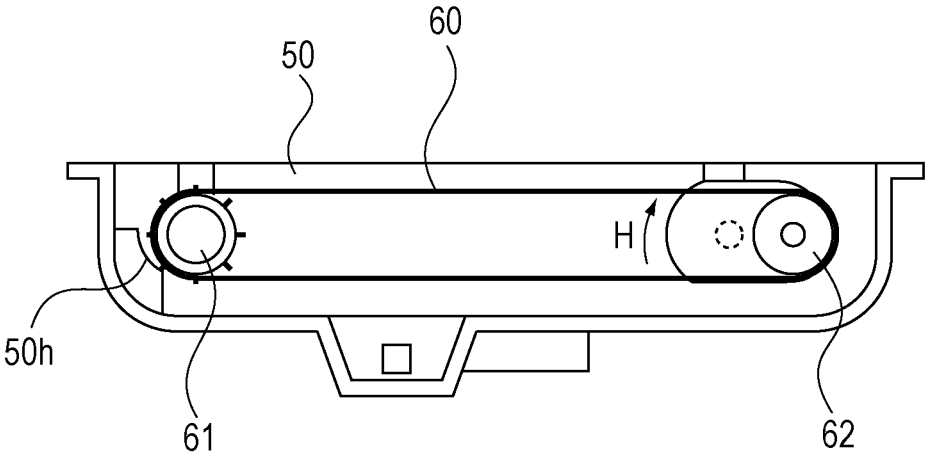

A configuration of the developer conveying belt will now be described in order of assembly, with reference to FIGS. 20A and 20B, FIGS. 21A and 21B, FIGS. 9A and 9B, and FIGS. 12A and 12B, which are drawings illustrating the assembly of the developing device 4. For ease of explanation, only parts related to the present embodiment will be described and the description of other parts will be omitted. FIGS. 9A and 9B are assembly diagrams illustrating how a driving roller and a driven roller are assembled to a developer conveying belt. FIGS. 20A and 20B are assembly diagrams illustrating how a toner conveying unit formed by the developer conveying belt and the like is assembled in a container. FIGS. 21A and 21B are cross-sectional views illustrating a loosened state and a stretched state, respectively, of the developer conveying belt. FIGS. 12A and 12B are perspective views illustrating a securing unit for securing the driven roller.

First, as illustrated in FIG. 9A, the driving roller 61 and the driven roller 62 are inserted into the inner space of the developer conveying belt 60 of endless type. The developer conveying belt 60 has a plurality of openings for passage of toner and a plurality of fin portions integral therewith for conveying and stirring toner. The description of the openings and the fin portions will be omitted here, as the more detailed description will be given later on. For example, a resin sheet made of polyethylene terephthalate (PET) resin, polycarbonate (PC) resin, or polyphenylene sulfide (PPS) resin may be used to form the developer conveying belt 60. The driving roller 61 has the sprockets 61*a* at both ends thereof. The driving force of the driving roller 61 is transmitted to the developer conveying belt 60 by engaging the sprockets 61*a* in the holes 60*c* at both ends of the developer conveying belt 60. As illustrated in FIG. 9B, the driven roller 62 is rotatably supported by the support member 66, whose shaft portion 66*a* is inserted in the driven roller 62. By securing the shaft end portion 66*c* to the protrusion 66*a*1, the movement of the driven roller 62 in the longitudinal direction is regulated by the shaft end portions 66*b* and 66*c*.

The assembly of the driving roller 61 will now be described. As illustrated in FIG. 20A, one end of the driving roller 61 in the longitudinal direction is rotatably supported by the driving roller shaft 63, which passes through the shaft hole 50*c*, from outside the lid member 50. The coupling of the driving roller 61 and the driving roller shaft 63 is made by engaging the two-way shaft 63*a* of the driving roller shaft 63 in the two-way hole 61*b* at the one end of the driving roller 61, and engaging the retaining nail 63*b* of the driving roller shaft 63 with the securing portion (not shown) for securing the driving roller 61. The seal member 64 is provided between the driving roller shaft 63 and the shaft hole 50*c*. The seal member 64 prevents toner from leaking through the shaft hole 50*c* of the lid member 50.

As illustrated in FIG. 20B, the driving roller 61 has the end shaft 61*c* at the other end thereof in the longitudinal direction. The end shaft 61*c* is fitted into the groove portion 50*d* of the lid member 50 and retained by the retaining portion 28*n*1 of the developing frame 28, whereby the driving roller 61 is rotatably supported. The bottom face (not shown) of the groove portion 50*d* rotatably supporting the end shaft 61*c* is in the shape of a U-shaped or V-shaped bearing. The driving roller shaft 63 has the gear portion 63*c* integral therewith. The driving roller shaft 63 transmits, to the driving roller 61, a driving force transmitted from the driving-force transmitting unit (not shown) having a gear train.

The assembly of the driven roller 62 will now be described. As illustrated in FIG. 9B, the driven roller 62 is rotatably supported by the support member 66. As illustrated in FIG. 20A, one end of the support member 66 in the longitudinal direction is rotatably supported by the driven roller shaft 65, which passes through the shaft hole 50*e*, from outside the lid member 50. The coupling of the support member 66 and the driven roller shaft 65 is made by engaging the two-way shaft 65*a* of the driven roller shaft 65 in the two-way hole 66*b*1 at the one end of the support member 66, and engaging the retaining nail (not shown) of the driven roller shaft 65 with the securing portion (not shown) for securing the support member 66. The seal member 64 is provided between the driven roller shaft 65 and the shaft hole 50*e*. The seal member 64 prevents toner from leaking through the shaft hole 50*e* of the lid member 50.

As illustrated in FIG. 20B, the other end of the support member 66 in the longitudinal direction is rotatably supported by the end shaft 66*c*1 in the shaft end portion 66*c* of the support member 66. The end shaft 66*c*1 is fitted into the groove portion 50*f* of the lid member 50 and retained by the retaining portion 28*n*2 of the developing frame 28, whereby the support member 66 is rotatably supported. The bottom face (not shown) of the groove portion 50*f* rotatably supporting the end shaft 66*c*1 is in the shape of a U-shaped or V-shaped bearing.

As illustrated in FIG. 9A, the axial line F of the shaft portion 66*a* (see FIG. 9B) of the support member 66 supporting the driven roller 62 is displaced from the axial line G connecting the center of the two-way hole 66*b*1 in the shaft end portion 66*b* of the support member 66 and the center of the end shaft 66*c*1 (see FIG. 20B) in the shaft end portion 66*c* of the support member 66. Thus, rotating the driven roller shaft 65 (see FIG. 20A) allows the driven roller 62 to swing about the axial line G.

A further description will be given with reference to the cross-sectional views of FIGS. 21A and 21B. FIG. 21A is a cross-sectional view illustrating a loosened state of the developer conveying belt 60. FIG. 21B is a cross-sectional view illustrating a stretched state of the developer conveying belt 60. When the driven roller 62 is rotated in the direction of arrow H, the driven roller 62 swings to stretch the developer conveying belt 60 between the driven roller 62 and the driving roller 61. The lid member 50 is internally provided with the ribs 50*h*. This is to prevent the sprockets 61*a* (see FIG. 9A) at both ends of the driving roller 61 from being disengaged from the holes 60*c* at both ends of the developer conveying belt 60 when the developer conveying belt 60 is loosened. The ribs 50*h* are disposed near the sprockets 61*a* at both ends of the driving roller 61.

FIGS. 12A and 12B are perspective views illustrating a configuration of a securing unit for securing the driven roller. FIG. 12A is a perspective view illustrating a state where the developer conveying belt 60 is biased in a loosened state. FIG. 12B is a perspective view illustrating a state where the developer conveying belt 60 is biased in a stretched state. The developing frame 28 and the lid member 50 illustrated in FIGS. 12A and 12B are joined together by welding or the like. The tension spring 67 serving as a biasing unit is stretched between the boss 65*d* of the driven roller shaft 65 and the boss 28*p* of the developing frame 28. Thus, when the developer conveying belt 60 is in a loosened state, the driven roller 62 is biased toward the inner surface 50*j* (see FIG. 21A) of the lid member 50. When the driven roller shaft 65 is rotated in the direction of arrow H, the developer conveying belt 60 is stretched by the biasing force of the tension spring 67 upon passage of the boss 65*d* of the driven roller shaft 65 over the axial line I which connects the center of the boss 28*p* of the developing frame 28 and the rotation center of the driven roller shaft 65. This configuration allows the developer conveying belt 60 to be reliably stretched, because variation in circumference caused by the tolerance of the developer conveying belt 60 can be accommodated.

A toner conveying configuration of the developing device 4 will now be described in detail with reference to FIGS. 19A and 19B.

Figure 19A:
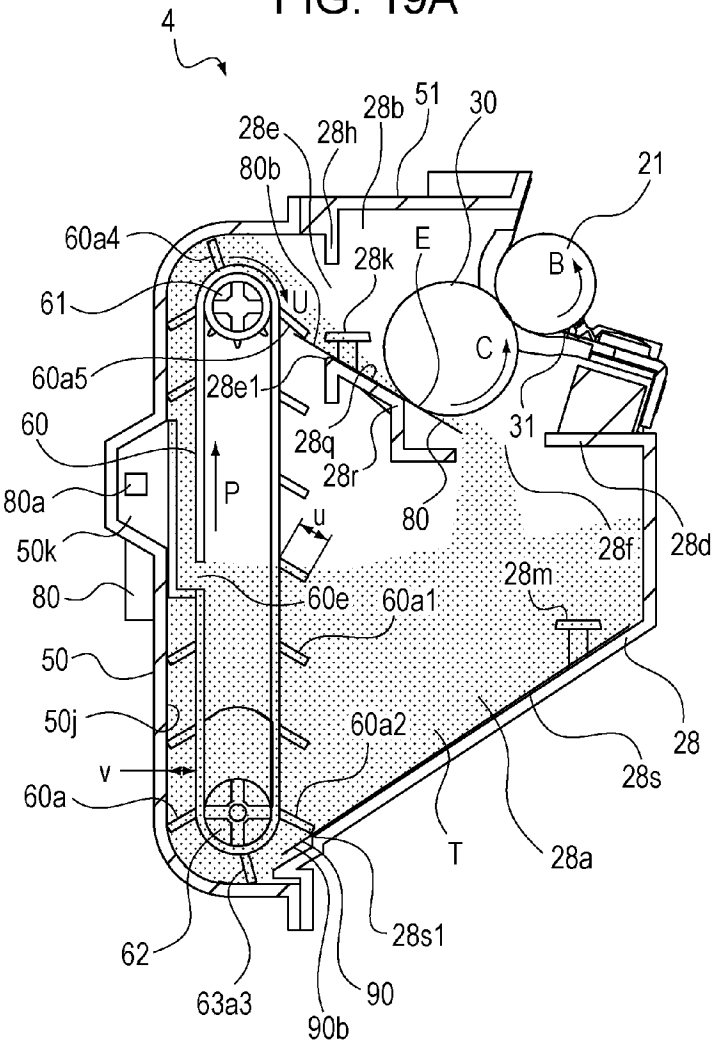

As illustrated in FIG. 19A, in the container 28*a*, the developer conveying belt 60 is supported by the driving roller 61 and the driven roller 62 such that it can run in the direction of arrow P. The developer conveying belt 60 has the fin portions 60*a* extending substantially horizontally in the longitudinal direction of the developing device 4. The width u of the fin portions 60*a* on the short side is set to be longer than the width v defined by the developer conveying belt 60 and the inner surface 50*j* of the lid member 50.

The fin portions 60*a* are set to be inclined with respect to the belt running direction or the direction of arrow P (as in the state of the fin portion 60*a*1). When the developer conveying belt 60 moves from this state, the fin portions 60*a* are brought into contact with the toner drop sheet member 90 in the vicinity of the driven roller 62 at the lower end of the container 28*a*, and inclined in the direction opposite the direction of travel (as in the state of the fin portion 60*a*2).

When the developer conveying belt 60 moves further, the fin portions 60*a* make a transition from the state of being in contact with the toner drop sheet member 90 to the state of being in contact with the lid member 50 while maintaining the inclination in the direction opposite the direction of travel (as in the state of the fin portion 60*a*3).

This state of the fin portions 60*a* is maintained while the fin portions 60*a* are in contact with the lid member 50, that is, during movement of the fin portions 60*a* from the vicinity of the driven roller 62 to the vicinity of the driving roller 61. Thus, toner held between adjacent fin portions 60*a* at the lower end of the container 28*a* is conveyed to the upper end of the container 28*a* as the developer conveying belt 60 runs.

When the contact between the fin portions 60*a* and the lid member 50 is released, the toner at the upper end of the container 28*a* is further conveyed by its own weight through the supply opening 28*e* to the developing chamber 28*b*. Then, the inclination of the fin portions 60*a* maintained in the direction opposite the direction of travel of the developer conveying belt 60 is released and returned to the inclination in the direction of travel (as in the state of the fin portion 60*a*1). By the elastic force generated at the release of the inclination, toner on the fin portions 60*a* (in the state of the fin portion 60*a*4) is delivered onto the toner conveying sheet member 80, and this facilitates movement of toner toward the developing chamber 28*b*. The toner conveyed to the developing chamber 28*b* is supplied to the toner supply roller 30 and then sequentially supplied to the developing roller 21.

The angle of inclination of the fin portions 60*a* in a natural state where the fin portions 60*a* are not in contact with the developing frame 28 (i.e., inclination of the fin portion 60*a*1) is set to be greater than the angle of repose of the developer. Therefore, after the contact between the fin portions 60*a* and the lid member 50 is released, toner on the fin portions 60*a* is supplied to the developing chamber 28*b* without remaining on the fin portions 60*a*.

The toner conveying sheet member 80 is attached to the inclined surface 28*q* forming the developing chamber 28*b*. The toner conveying sheet member 80 is formed by an elastic sheet and retained by inserting the bosses 28*k* of the inclined surface 28*q* into the holes on the upper side of the sheet. The toner conveying sheet member 80 interferes with the fin portions 60*a* as the developer conveying belt 60 runs, and has an elastic force smaller than that of the developer conveying belt 60. Therefore, when the developer conveying belt 60 interferes with the toner conveying sheet member 80, the toner conveying sheet member 80 is warped by its own elasticity as illustrated in FIG. 19B. When the developer conveying belt 60 further runs, the interference between the toner conveying sheet member 80 and the developer conveying belt 60 is released, and the toner conveying sheet member 80 is returned to the state of FIG. 19A by its own elastic force. By vibration transmitted through the toner conveying sheet member 80, toner conveyed from the developer conveying belt 60 onto the toner conveying sheet member 80 is reliably supplied to the toner supply roller 30. Since the angle of inclination of the inclined surface 28*q* can be set to be smaller than the angle of repose of the toner, the size of the developing chamber 28*b* in the height direction can be reduced. Then, the toner is sequentially supplied from the toner supply roller 30 to the developing roller 21. An amount of toner greater than that required for the toner supply roller 30 and the developing roller 21 is collected through the discharge opening 28*f* in the container 28*a*.

As described above, toner in the container 28*a* is conveyed by the developer conveying belt 60 while being retained in small amounts between adjacent fin portions 60*a*, and is then supplied to the developing chamber 28*b*. After only the amount required for development is supplied to the developing roller 21, excess toner is collected in the container 28*a*. In other words, toner circulates between the container 28*a* and the developing chamber 28*b*.

(Residual Quantity Detecting Configuration)

Figure 22:
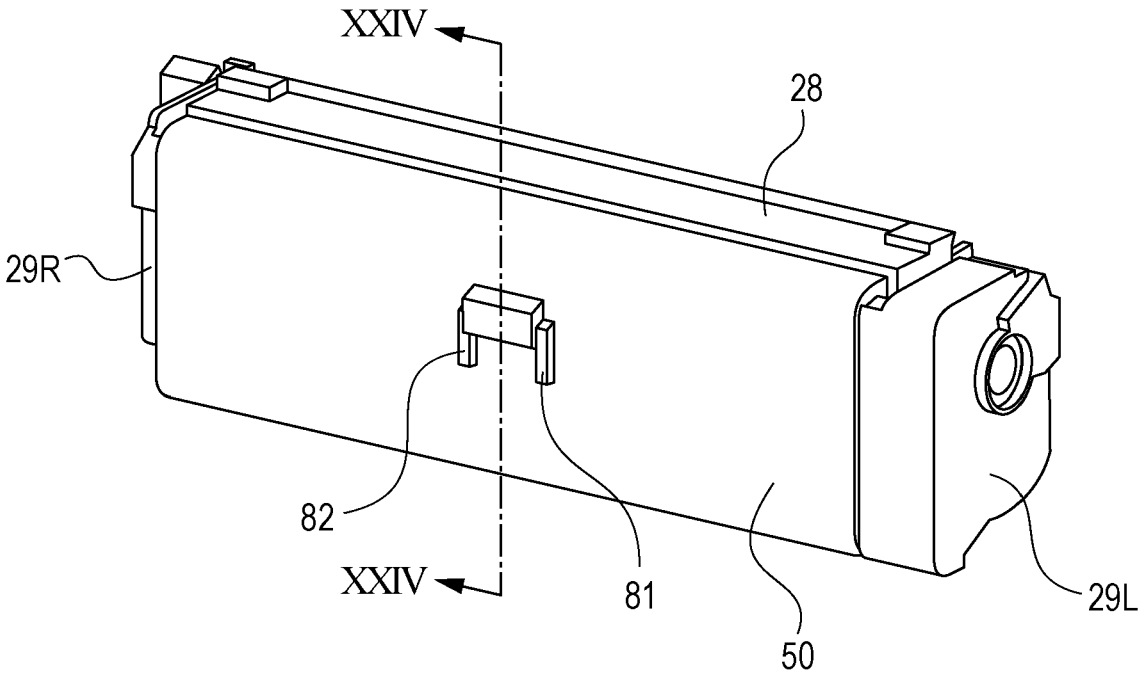
FIG. 22 is a perspective view of the developing device according to the third embodiment.
Figure 23A:
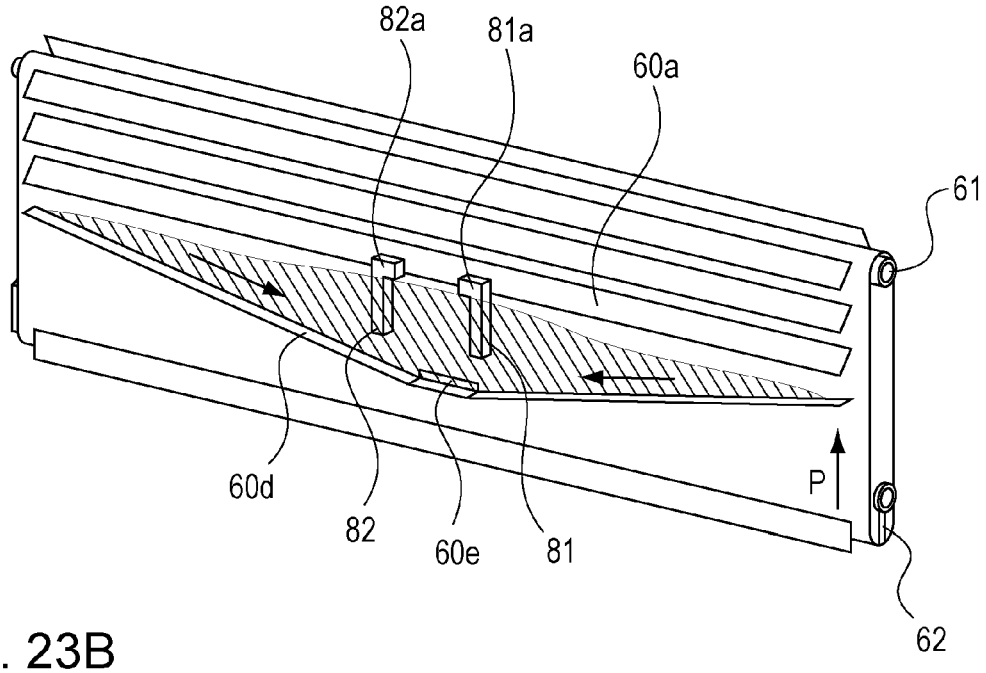
FIGS. 23A and 23B are perspective views of the developer conveying belt according to the third embodiment.
Figure 23B:
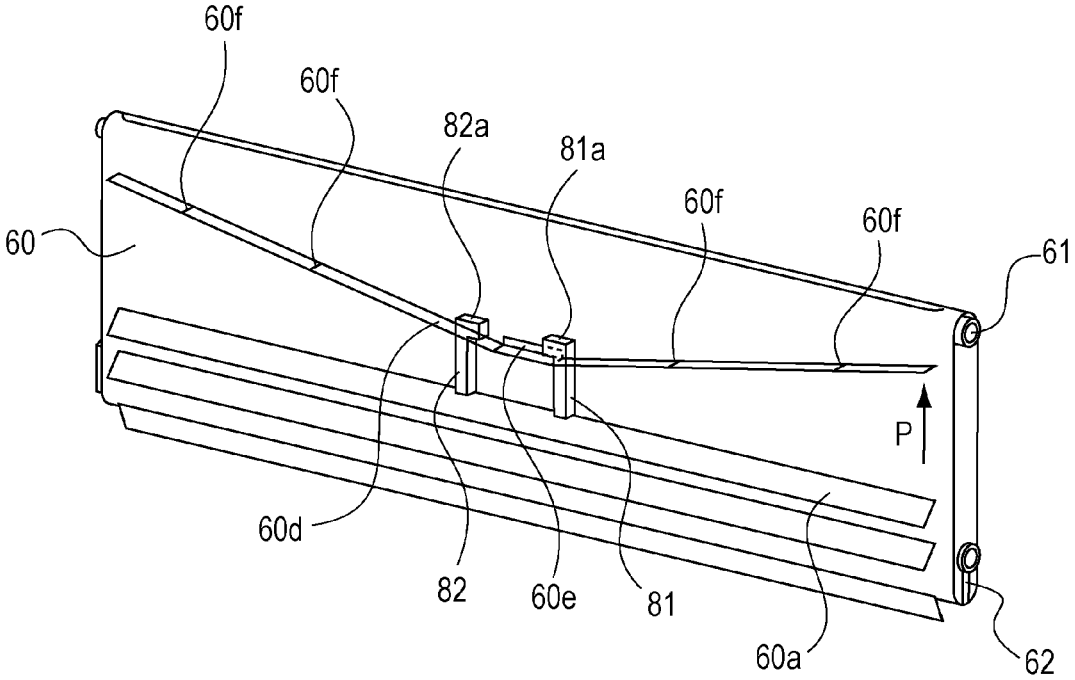
Figure 24B:
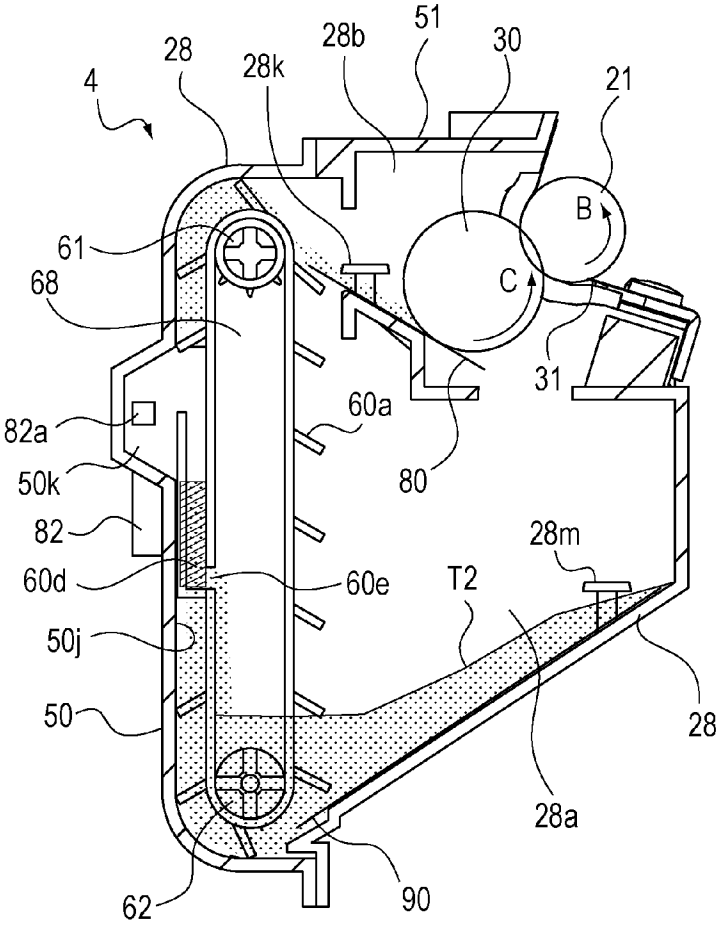
FIGS. 24A and 24B are cross-sectional views of the developing device according to the third embodiment.
Figure 24A:
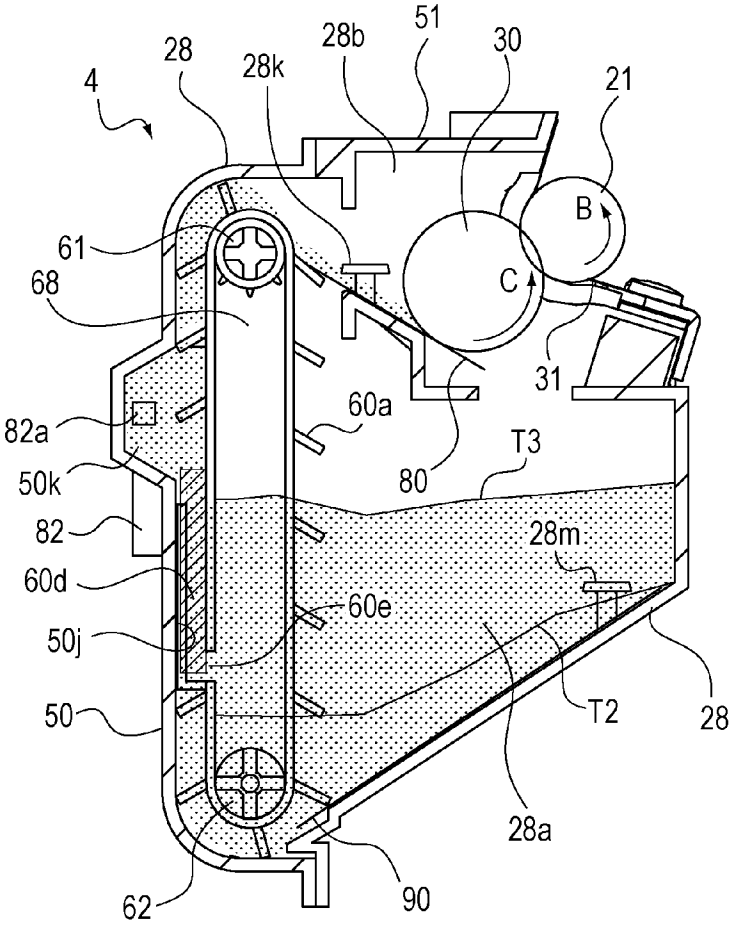

A detecting unit for detecting the amount of toner in the container 28*a* will now be described with reference to FIG. 17, FIG. 22, FIGS. 23A and 23B, and FIGS. 24A and 24B. FIG. 22 is a perspective view of the developing device 4 as viewed from the lid member 50. FIGS. 23A and 23B are perspective views of a configuration of the developer conveying belt 60 and a residual quantity detector, as viewed from the same side as FIG. 22. For convenience of illustration, other components are not shown in FIGS. 23A and 23B. FIGS. 24A and 24B are cross-sectional views of the developing device 4 taken along line XXIV-XXIV in FIG. 22.

First, the residual quantity detector will be described. As illustrated in FIG. 22, a light emitting element 82 and a light receiving element 81 are attached to the lid member 50 of the developing device 4. As illustrated in FIGS. 24A and 24B, the light emitting element 82 passes through the lid member 50, and is disposed with a light emitting portion 82*a* thereof exposed to the interior of a recessed portion 50*k* of the lid member 50. The light receiving element 81 is similarly disposed on the lid member 50. As illustrated in FIGS. 23A and 23B, the light receiving element 81 is configured such that a light receiving portion 81*a* thereof faces the light emitting portion 82*a*. A series of detecting operations first involves receiving light from a detecting unit (not shown) of the image forming apparatus 100 at the light emitting element 82, receiving the light at the light receiving element 81 through the recessed portion 50*k* of the lid member 50, and then receiving the light at the detecting unit of the image forming apparatus 100.

As illustrated in FIG. 23A, in the present embodiment, the developer conveying belt 60 has at least one V-shaped fin portion 60*d* different from the fin portions 60*a*. The V-shaped fin portion 60*d* has a hole 60*e* in the center thereof in the longitudinal direction (axial direction). During movement of the developer conveying belt 60, toner in the container 28*a* is retained in the state indicated by oblique lines in FIGS. 23A and 24A. In this state, for example, if the toner surface is at T2 in FIG. 24A, the toner is discharged through the hole 60*e* into an inner space 68 of the developer conveying belt 60 as the developer conveying belt 60 moves (see FIG. 24B). Thus, the amount of toner retained by the V-shaped fin portion 60*d* (i.e., the amount of toner indicated by oblique lines in FIG. 23A) is reduced. Therefore, as illustrated in FIG. 23B, until the hole 60*e* reaches the vicinity of the light emitting portion 82*a* and the light receiving portion 81*a* serving as the residual quantity detector, toner is absent and light can be received by the light receiving portion 81*a*.

On the other hand, when the toner surface in the container 28*a* is at T3 in FIG. 24A, no toner is discharged through the hole 60*e* until the hole 60*e* reaches the vicinity of the light emitting portion 82*a* and the light receiving portion 81*a* serving as the residual quantity detector. Therefore, the amount of toner indicated by oblique lines in FIGS. 23A and 24A is kept unchanged, and the recessed portion 50*k* of the lid member 50 having the residual quantity detector therein is filled with toner. This means that the light receiving portion 81*a* cannot receive light from the light emitting portion 82*a*.

As described above, in accordance with the amount of toner in the container 28*a*, the amount of toner retained by the V-shaped fin portion 60*d* varies, and the amount of empty space having no toner therein when passing through the residual quantity detector also varies. This varies the length of time during which the recessed portion 50*k* of the lid member 50 having the residual quantity detector therein is not filled with toner. Therefore, by detecting a change in the duration of passage of light, the residual quantity detector can detect a change in the amount of residual toner in the container 28*a*.

The developer conveying belt 60 has at least one V-shaped fin portion 60*d*, which has surfaces inclined with respect to the developer conveying direction (i.e., direction of travel P of the developer conveying belt 60) and the longitudinal direction of the developer conveying belt 60. Therefore, toner retained by the V-shaped fin portion 60*d* is reliably collected in the hole 60*e* in the center, with the help of its own weight. In the present embodiment, the hole 60*e* is located in the center of the V-shaped fin portion 60*d* in the longitudinal direction. However, as long as the V-shaped fin portion 60*d* has surfaces inclined toward the hole 60*e*, the same effect as above can be achieved regardless of the location of the hole 60*e* in the longitudinal direction.

The developing device 4 is configured such that when the hole 60*e* passes the residual quantity detector, that is, after the timing of residual quantity detection, the openings 60*b* (see FIG. 17) appropriately provided in the developer conveying belt 60 are during passage through the container 28*a*. Thus, with the openings 60*b*, the toner surface in the container 28*a* becomes level with the toner surface in the inner space 68 of the developer conveying belt 60.

The V-shaped fin portion 60*d* has a plurality of slits 60*f* (see FIG. 23B). This allows the V-shaped fin portion 60*d* to smoothly operate even when passing through the vicinities of the driving roller 61 and the driven roller 62 at the top and bottom ends, respectively, of the developer conveying belt 60. Although the V-shaped fin portion 60*d* has a plurality of slits 60*f* in the present embodiment, the configuration is not limited to this, as long as at least one slit is provided.

As described above, the present embodiment uses the developer conveying belt 60 in the developing device 4 in which the container 28*a* is disposed below the developing chamber 28*b*. This allows supply of toner in small amounts and reduces scattering of toner. Also, by detecting toner retained in the space between the developer conveying belt 60 and the inner wall of the lid member 50, it is possible to reduce entry of scattered toner into the space between the light emitting portion 82*a* and the light receiving portion 81*a*, and detect the amount of residual toner with high accuracy.

Fourth Embodiment

A color electrophotographic image forming apparatus (hereinafter referred to as an image forming apparatus) and a process cartridge (hereinafter referred to as a cartridge) according to a fourth embodiment will be described.

Figure 25:
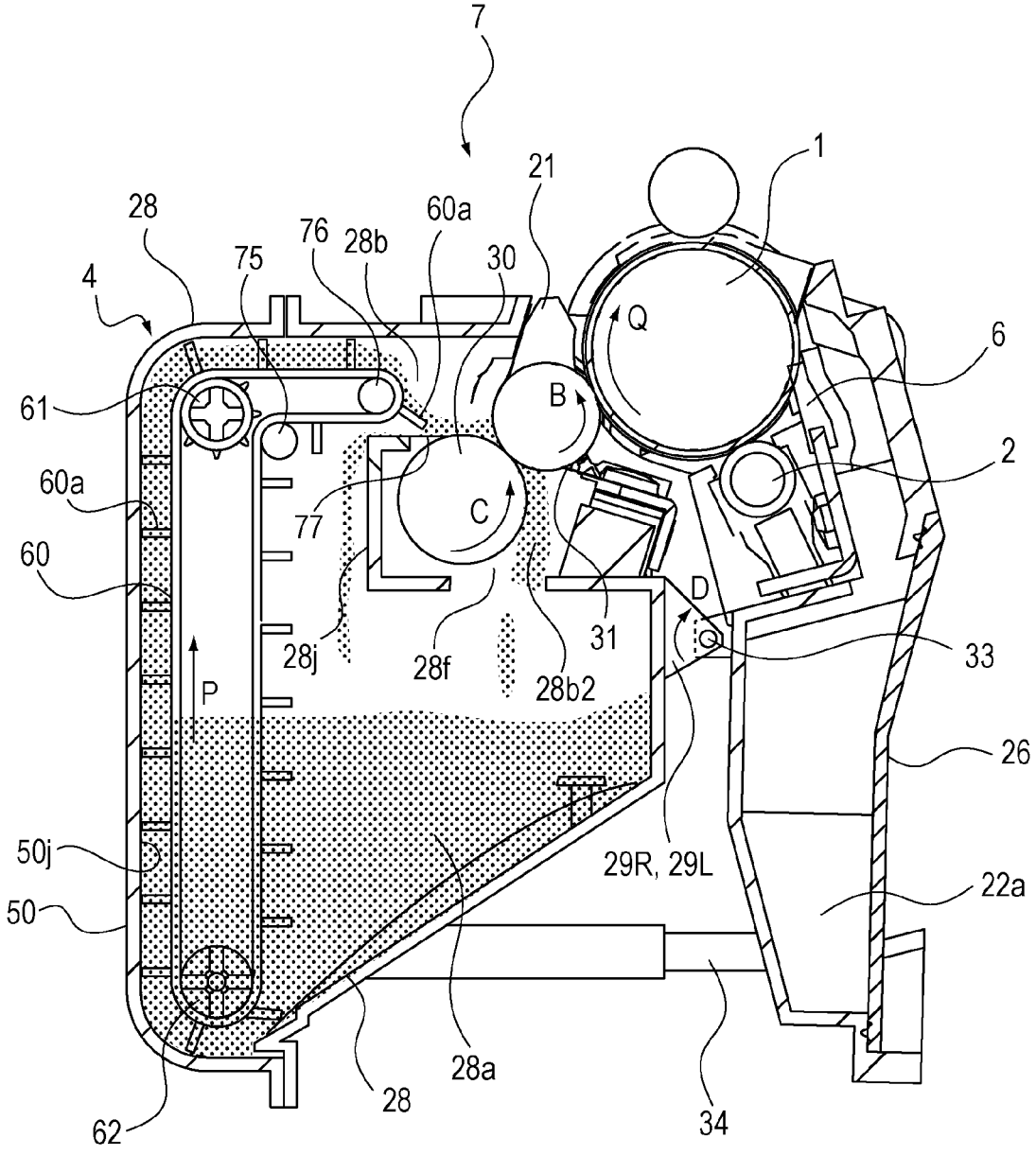
FIG. 25 is a principal cross-sectional view of a cartridge according to a fourth embodiment.
Figure 26:
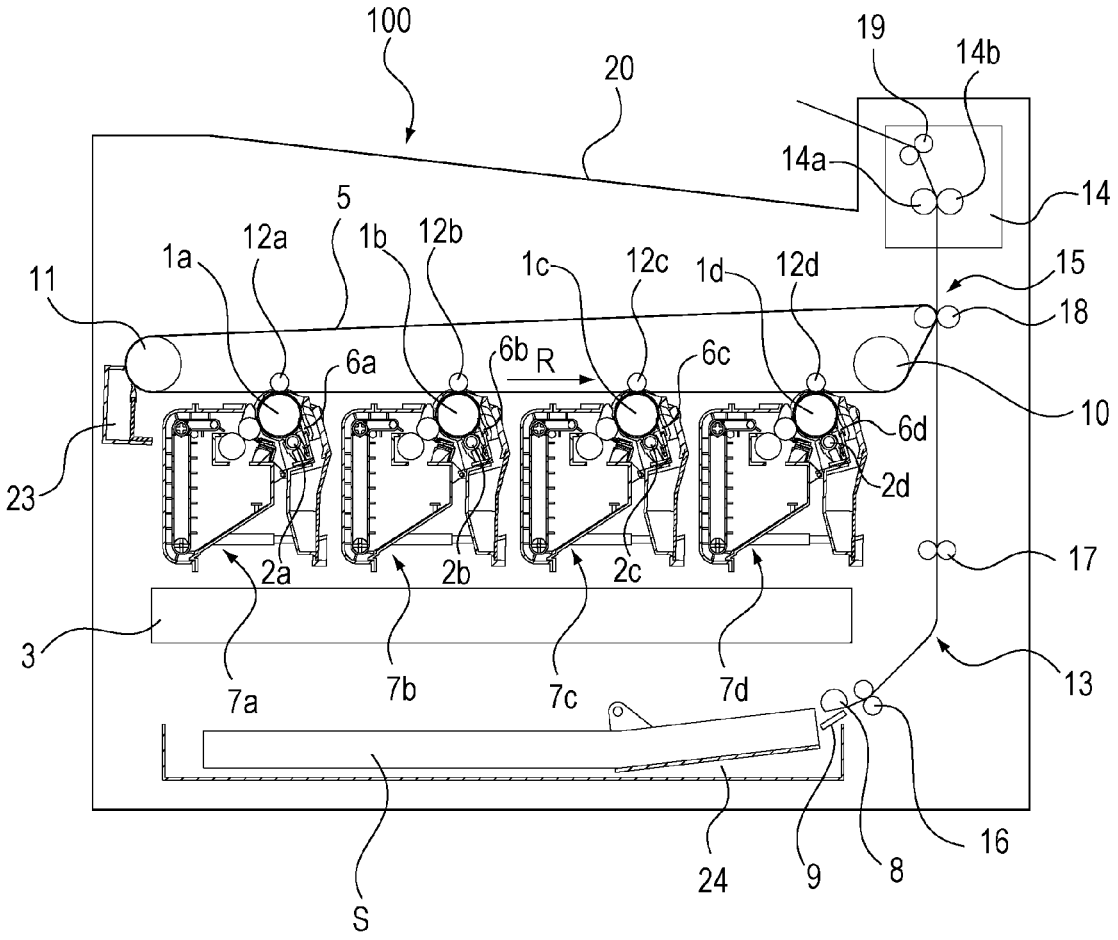
FIG. 26 is a principal cross-sectional view of an image forming apparatus according to the fourth embodiment.
Figure 27A:
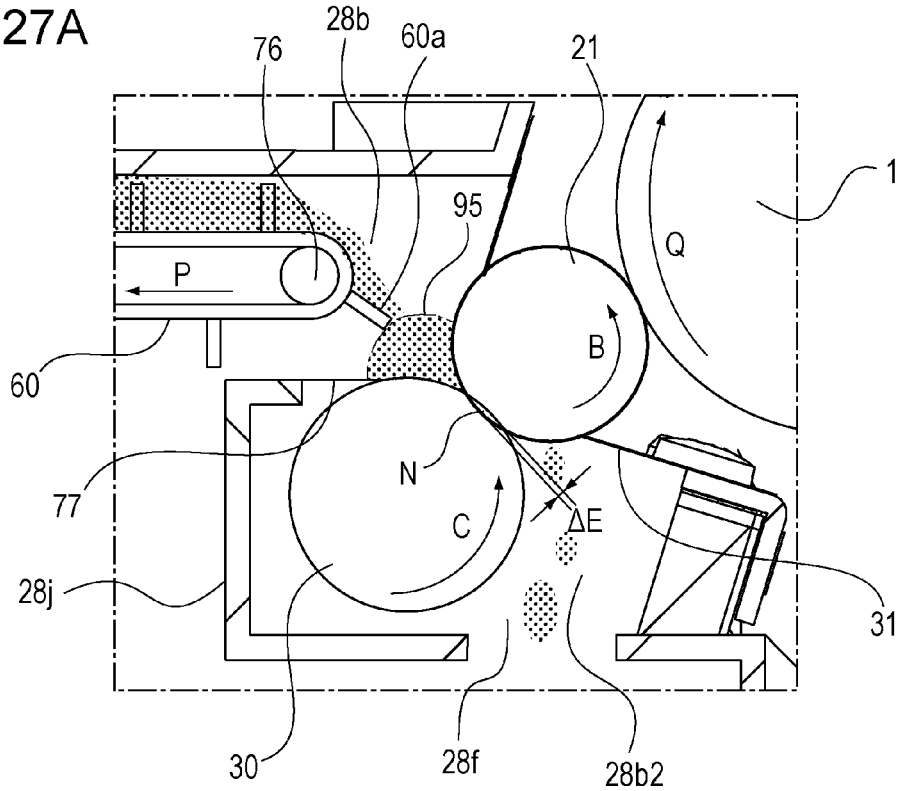
FIGS. 27A and 27B are principal cross-sectional views illustrating an area around a developing device of the cartridge according to the fourth embodiment.
Figure 27B:
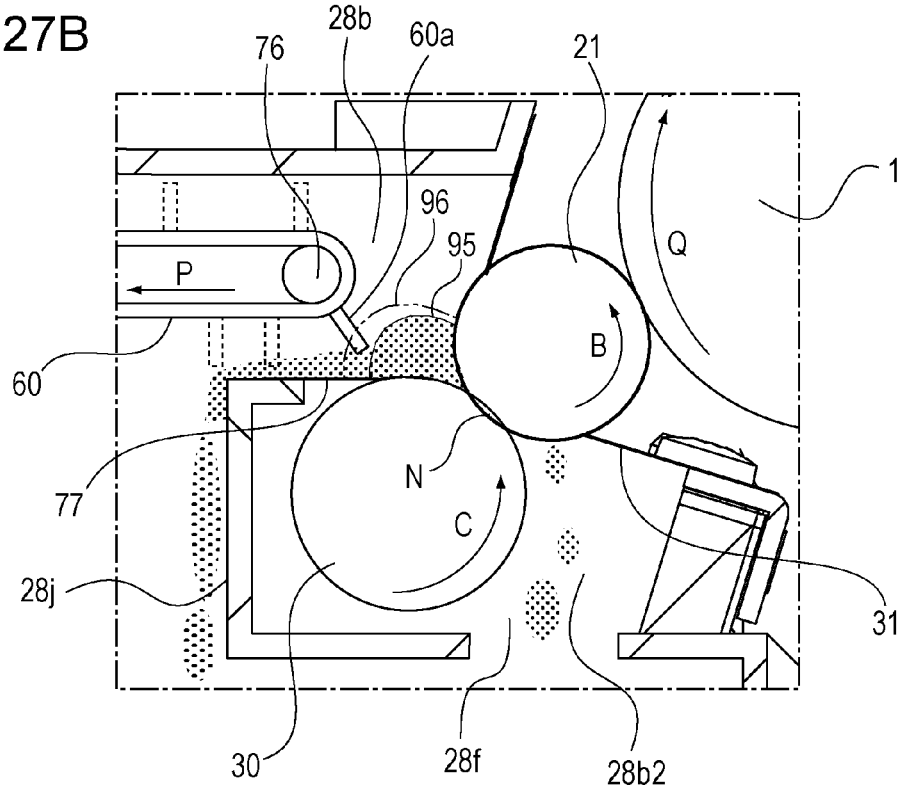

A general configuration of the image forming apparatus and a configuration of the cartridge are the same as those in the above-described embodiments, except for the detailed configuration of the developing device. Therefore, components having the same functions as those in the above-described embodiments are denoted by the same reference numerals as in FIGS. 25 and 26, and their description will be omitted. FIG. 25 is a principal cross-sectional view of the cartridge 7 containing toner T according to the fourth embodiment. FIG. 26 is a principal cross-sectional view of the image forming apparatus 100 according to the fourth embodiment. FIGS. 27A and 27B are principal cross-sectional views illustrating an area around the developing device 4 of the cartridge 7 according to the fourth embodiment.

As illustrated in FIG. 27A, in the developing device 4, the toner supply roller 30 is disposed to form a nip N, which is a predetermined contact portion, at the location where the toner supply roller 30 and the developing roller 21 face each other. As illustrated, the toner supply roller 30 rotates in the direction of arrow C. Here, the toner supply roller 30 is an elastic sponge roller produced by forming a foam layer on a conductive cored bar.

On the other hand, the developing roller 21 is a rubber roller produced by forming a rubber layer harder than the sponge layer of the toner supply roller 30 on a conductive cored bar. Thus, as illustrated in FIG. 27A, the toner supply roller 30 and the developing roller 21 are in contact with each other, with the toner supply roller 30 being depressed by the developing roller 21 by a certain amount ΔE. At the nip N, the developing roller 21 and the toner supply roller 30 rotate in relatively opposite directions (i.e., in the directions of arrows B and C in FIGS. 27A and 27B). Thus, the toner supply roller 30 not only supplies toner to the developing roller 21, but also strips off the toner remaining on the developing roller 21 after development. The toner supply roller 30 is disposed with respect to the developing roller 21 such that the downstream end of the nip (contact portion) N in the rotation direction of the toner supply roller 30 is located above the upstream end of the nip N.

(Detailed Configuration of Developing Device)

A supply unit for supplying toner from the container 28*a* to the developing chamber 28*b* will now be described in detail with reference to FIG. 25 and FIGS. 27A and 27B.

Toner can be supplied to the toner supply roller 30 most efficiently by conveying it to a location (toner accumulated portion 95) immediately after the nip N between the developing roller 21 and the toner supply roller 30 on the downstream side in the rotation direction of the toner supply roller 30. In the toner supply roller 30 including an elastic layer having a plurality of cells on the outer periphery thereof, the elastic layer coming out of the nip N is released from pressure and this allows the cells to be opened immediately after the nip N. Then, because of the resulting suction of air, toner is absorbed into the elastic portion of the toner supply roller 30. Therefore, to allow toner to be efficiently retained by the toner supply roller 30, it is desirable to convey the toner directly to the absorbing portion. Note that the elastic portion of the toner supply roller 30 is the sponge layer (surface layer) of the toner supply roller 30, and the plurality of cells are bubbles in the sponge layer.

Efficient supply of toner to the nip N between the toner supply roller 30 and the developing roller 21 will now be described in detail. The present embodiment uses the developer conveying belt 60 to supply toner in small amounts for prevention of excessive toner supply, and also to bring up toner from the container 28*a* in the lower part of the developing device 4 to the developing chamber 28*b* in the upper part of the developing device 4.

As described above, the developing device 4 has the developing chamber 28*b* on the upper side and the container 28*a* on the lower side. The developing chamber 28*b* contains the developing roller 21, the toner supply roller 30, and the developing blade 31. The container 28*a* contains the toner T to be supplied to the developing chamber 28*b*, and the developer conveying belt 60. The developing chamber 28*b* and the container 28*a* are formed by the developing frame 28, the mandible-like member (second developing frame) 51, and the lid member 50. A partition 28*j* and the discharge opening 28*f* are provided between the developing chamber 28*b* and the container 28*a*. The container 28*a* contains the developer conveying belt 60 serving as a supply unit that supplies the toner T to the developing chamber 28*b*. The developer conveying belt 60 is driven to move in the direction of arrow P by a driving unit (not shown) in the image forming apparatus 100.

Figure 28A:
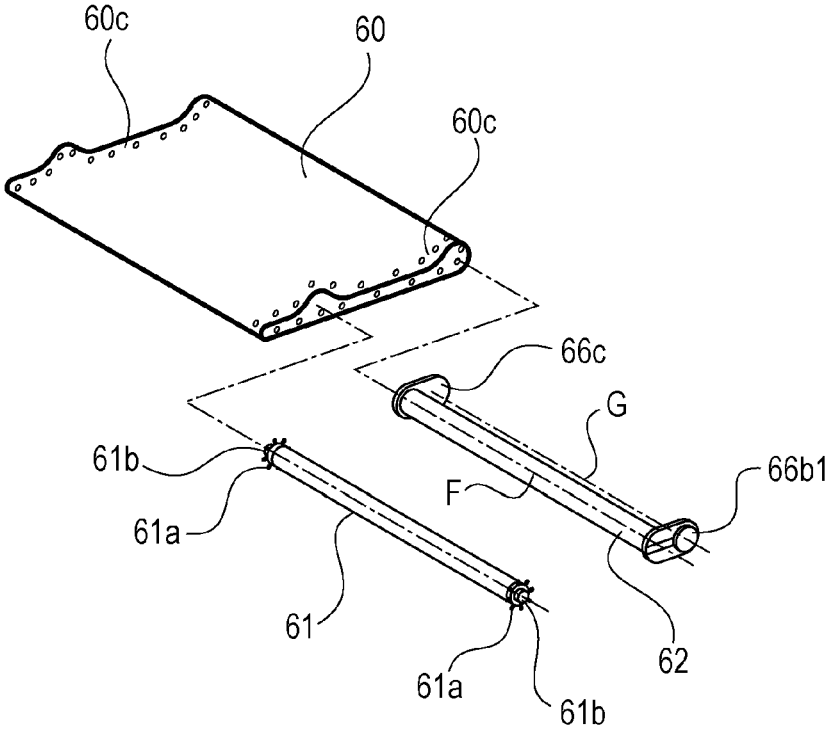
FIGS. 28A and 28B are exploded perspective views illustrating a configuration of a developer conveying belt according to the fourth embodiment.
Figure 28B:
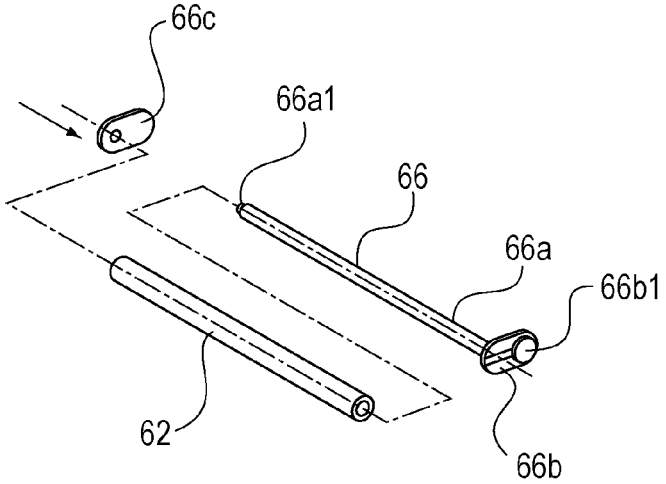
Figure 29A:
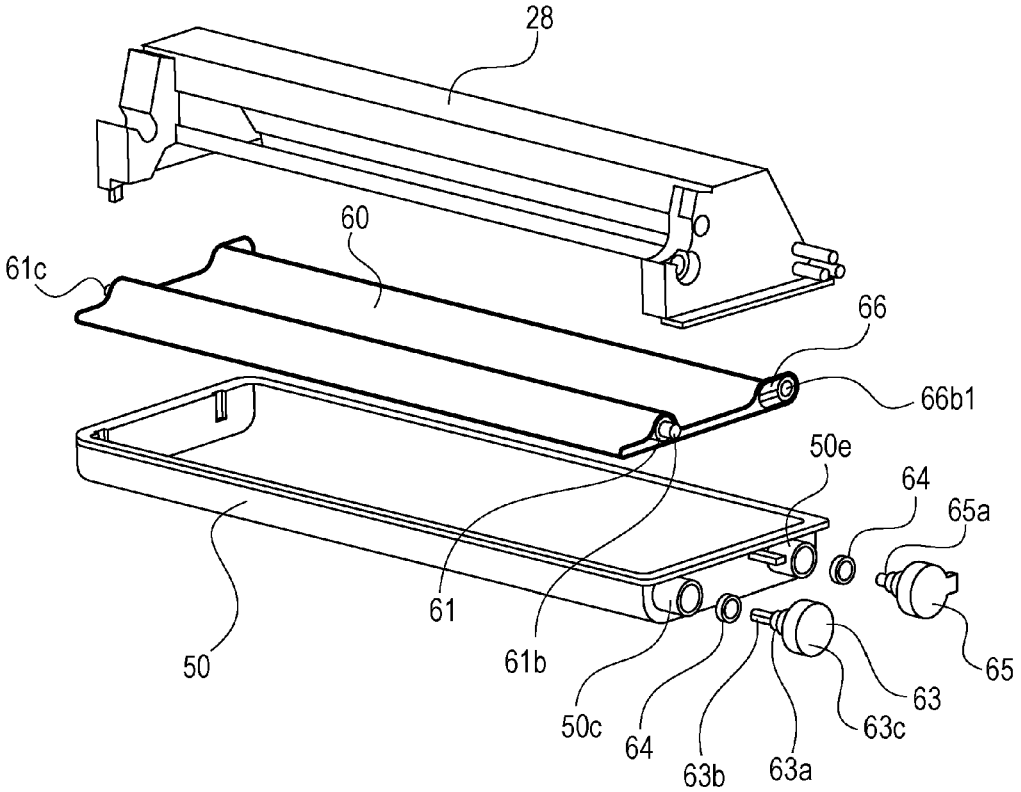
FIGS. 29A and 29B are exploded perspective views illustrating a configuration of the developing device according to the fourth embodiment.
Figure 29B:
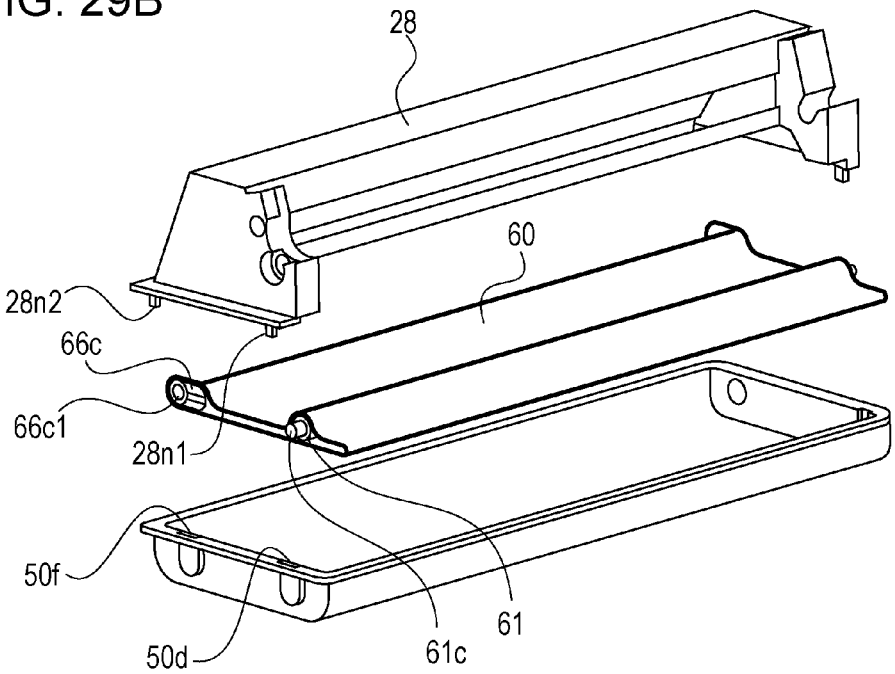
Figure 30:
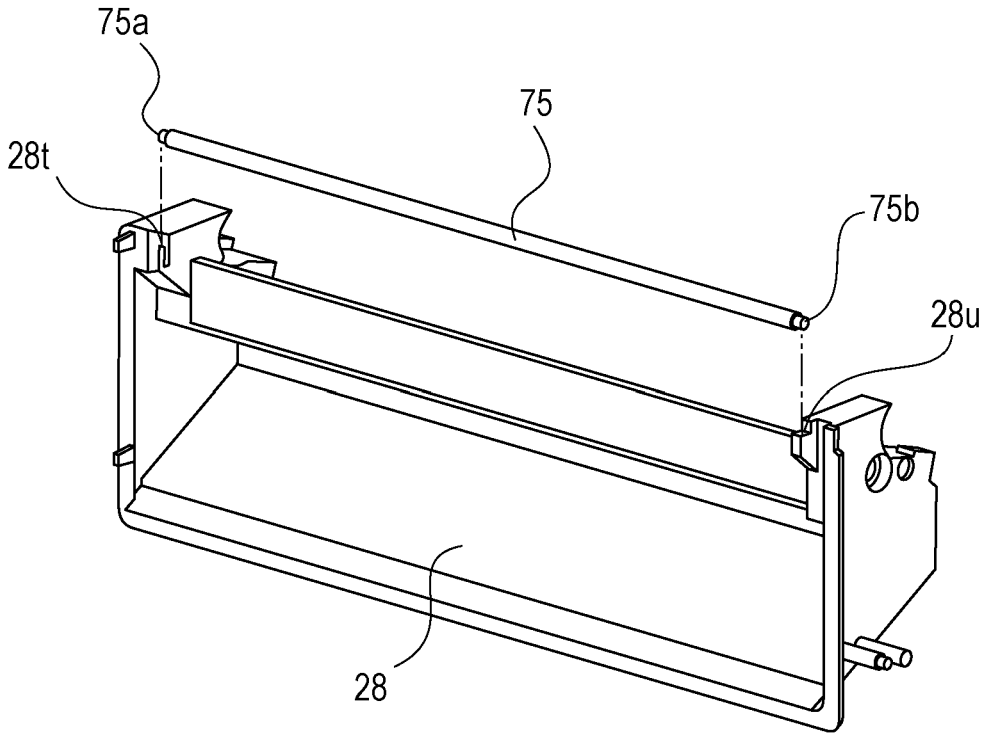
FIG. 30 is an exploded perspective view illustrating a configuration of the developing device according to the fourth embodiment.
Figure 31A:
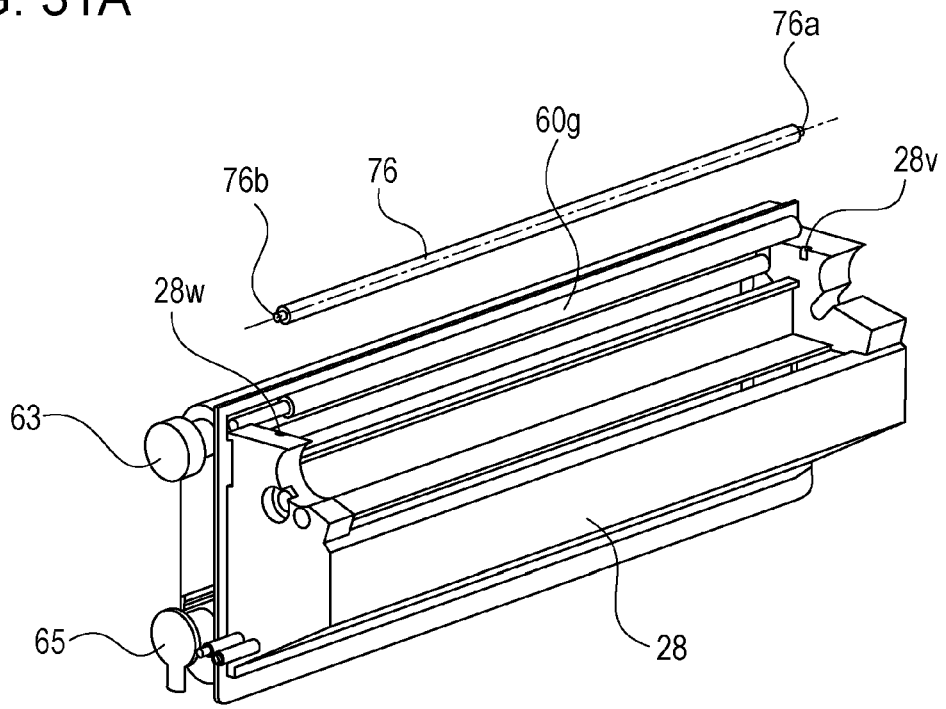
FIGS. 31A and 31B are exploded perspective views illustrating a configuration of the developing device according to the fourth embodiment.
Figure 31B:
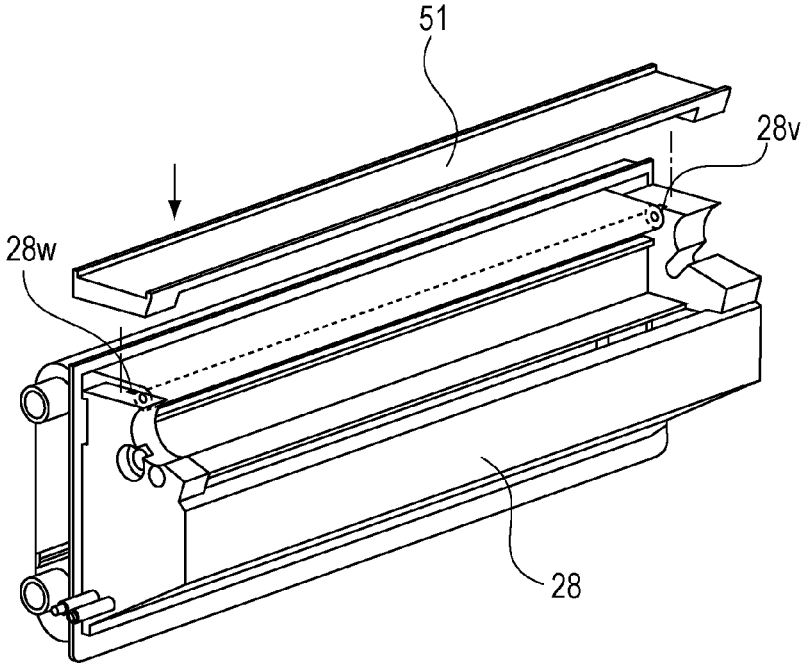
Figure 32A:
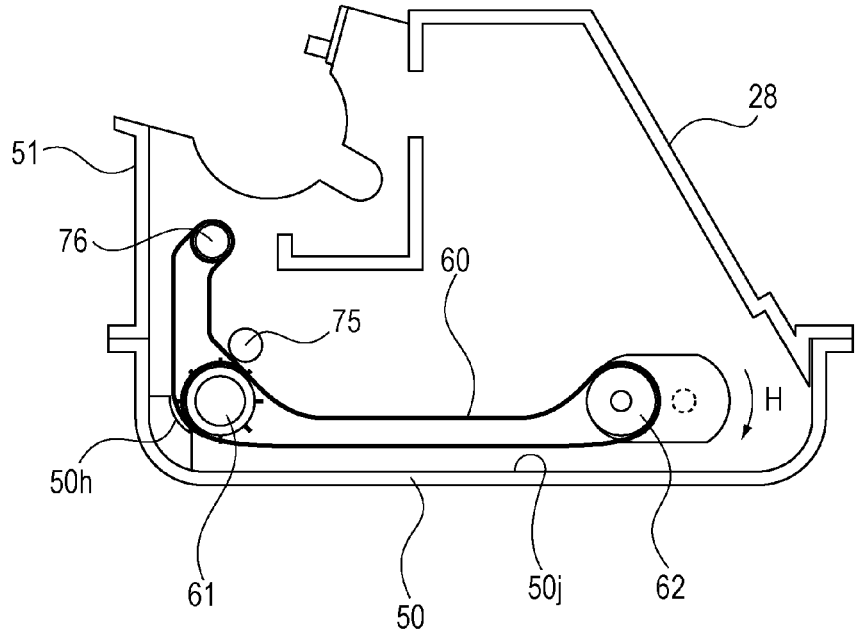
FIGS. 32A and 32B are cross-sectional views illustrating a configuration of the developing device according to the fourth embodiment.
Figure 32B:
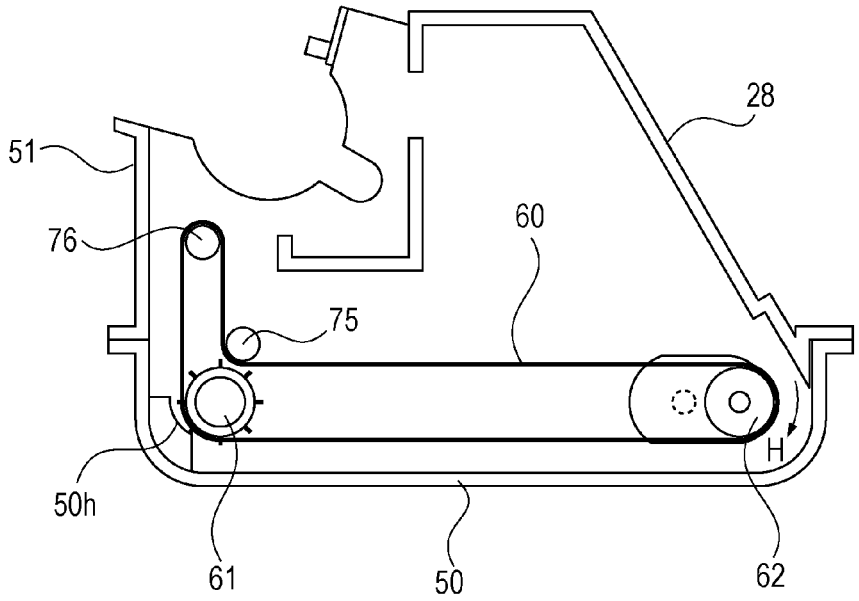
Figure 33A:
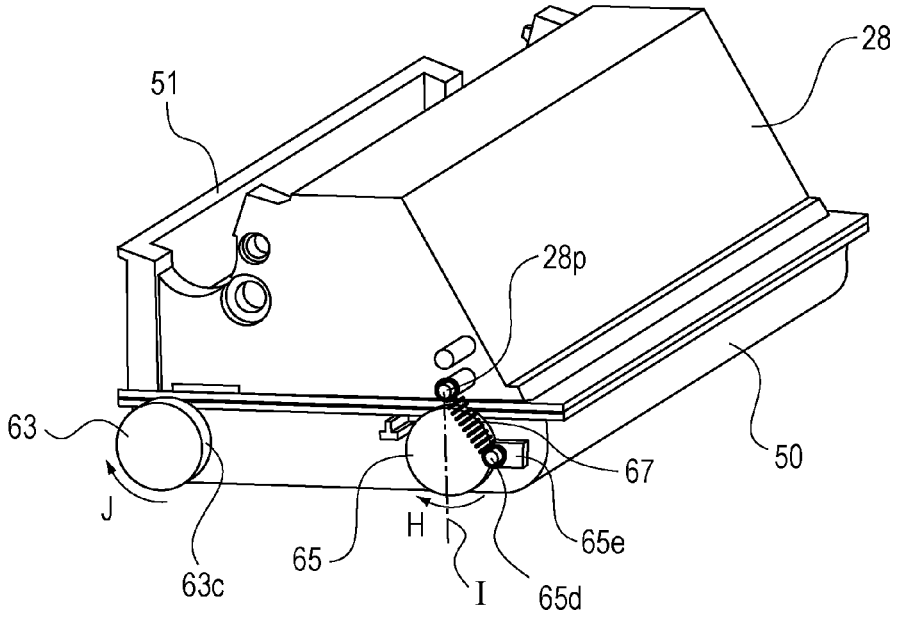
FIGS. 33A and 33B are perspective views illustrating a securing unit for securing the driven roller according to the fourth embodiment.
Figure 33B:
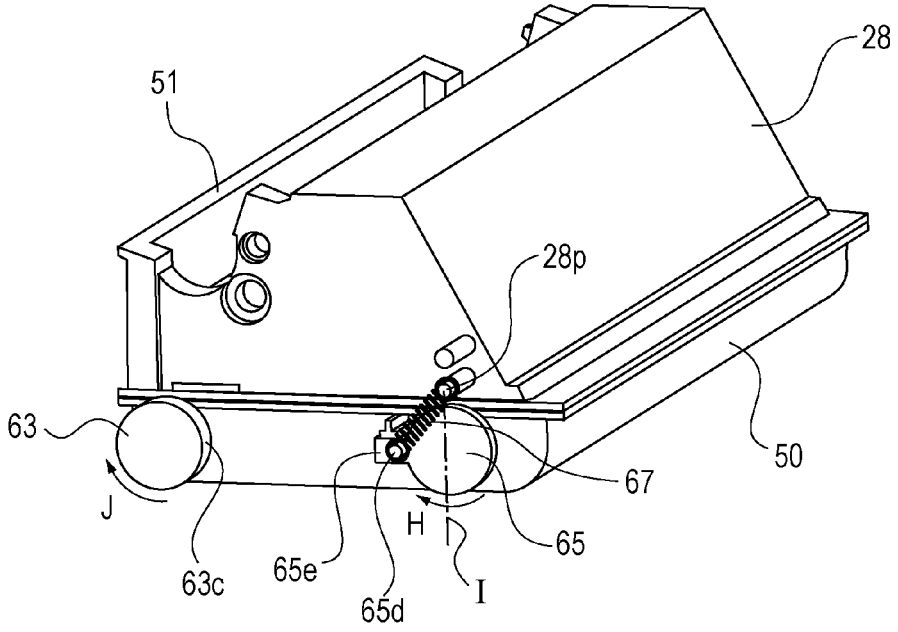

A configuration of the developer conveying belt 60 will be described in detail in order of assembly of the developing device 4, with reference to FIGS. 28A and 28B to FIGS. 33A and 33B, which are drawings illustrating the assembly of the developing device 4. For ease of explanation, only parts related to the present embodiment will be described and the description of other parts will be omitted. FIGS. 28A and 28B are assembly diagrams illustrating how a driving roller and a driven roller are assembled to a developer conveying belt. FIGS. 29A and 29B are assembly diagrams illustrating how a toner conveying unit formed by the developer conveying belt and the like is assembled in a container. FIG. 30 is an assembly diagram illustrating how a driven roller is assembled to a developing frame. FIGS. 31A and 31B are assembly diagrams illustrating how the developer conveying belt is assembled to a developing device. FIGS. 32A and 32B are cross-sectional views illustrating a loosened state and a stretched state, respectively, of the developer conveying belt. FIGS. 33A and 33B are perspective views illustrating a securing unit for securing the driven roller.

First, as illustrated in FIG. 28A, the driving roller 61 and the driven roller 62 are inserted into the inner space of the developer conveying belt 60 of endless type. The developer conveying belt 60 has fin portions (protruding portions) integral therewith for conveying and stirring toner. The description and illustration of the fin portions will be omitted here, as the more detailed description will be given later on. For example, a resin sheet made of polyethylene terephthalate (PET) resin, polycarbonate (PC) resin, or polyphenylene sulfide (PPS) resin may be used to form the developer conveying belt 60. The driving roller 61 has the sprockets 61*a* at both ends thereof. The driving force of the driving roller 61 is transmitted to the developer conveying belt 60 by engaging the sprockets 61*a* in the holes 60*c* at both ends of the developer conveying belt 60.

As illustrated in FIG. 28B, the driven roller 62 is rotatably supported by a support member 66, whose shaft portion 66*a* is inserted in the driven roller 62. By securing the shaft end portion 66*c* to the protrusion 66*a*1, the movement of the driven roller 62 in the longitudinal direction is regulated by shaft end portions 66*b* and 66*c*.

The assembly of the driving roller 61 will now be described. As illustrated in FIG. 29A, one end of the driving roller 61 in the longitudinal direction is rotatably supported by the driving roller shaft 63, which passes through the shaft hole 50*c*, from outside the lid member 50. The coupling of the driving roller 61 and the driving roller shaft 63 is made by engaging the two-way shaft 63*a* of the driving roller shaft 63 in the two-way hole 61*b* at the one end of the driving roller 61, and engaging the retaining nail 63*b* of the driving roller shaft 63 with the securing portion (not shown) for securing the driving roller 61. The seal member 64 is provided between the driving roller shaft 63 and the shaft hole 50*c*. The seal member 64 prevents toner from leaking through the shaft hole 50*c* of the lid member 50.

As illustrated in FIG. 29B, the driving roller 61 has the end shaft 61*c* at the other end thereof in the longitudinal direction. The end shaft 61*c* is fitted into the groove portion 50*d* of the lid member 50 and retained by the retaining portion 28*n*1 of the developing frame 28, whereby the driving roller 61 is rotatably supported. The bottom face (not shown) of the groove portion 50*d* rotatably supporting the end shaft 61*c* is in the shape of a U-shaped or V-shaped bearing. The driving roller shaft 63 has the gear portion 63*c* (see FIG. 29A) integral therewith. The driving roller shaft 63 transmits, to the driving roller 61, a driving force transmitted from the driving-force transmitting unit (not shown) having a gear train.

The assembly of the driven roller 62 will now be described. As illustrated in FIG. 28B, the driven roller 62 is rotatably supported by the support member 66. As illustrated in FIG. 29A, one end of the support member 66 in the longitudinal direction is rotatably supported by the driven roller shaft 65, which passes through the shaft hole 50*e*, from outside the lid member 50. The coupling of the support member 66 and the driven roller shaft 65 is made by engaging the two-way shaft 65*a* of the driven roller shaft 65 in the two-way hole 66*b*1 at the one end of the support member 66, and engaging the retaining nail (not shown) of the driven roller shaft 65 with the securing portion (not shown) for securing the support member 66. The seal member 64 is provided between the driven roller shaft 65 and the shaft hole 50*e*. The seal member 64 prevents toner from leaking through the shaft hole 50*e* of the lid member 50.

As illustrated in FIG. 29B, the other end of the support member 66 in the longitudinal direction is rotatably supported by the end shaft 66*c*1 in the shaft end portion 66*c* of the support member 66. The end shaft 66*c*1 is fitted into the groove portion 50*f* of the lid member 50 and retained by the retaining portion 28*n*2 of the developing frame 28, whereby the support member 66 is rotatably supported. The bottom face of the groove portion 50*f* rotatably supporting the end shaft 66*c*1 is in the shape of a U-shaped or V-shaped bearing.

As illustrated in FIGS. 28A and 28B, the axial line F of the shaft portion 66*a* of the support member 66 supporting the driven roller 62 is displaced from the axial line G connecting the center of the two-way hole 66*b*1 in the shaft end portion 66*b* of the support member 66 and the center of the end shaft 66*c*1 (see FIG. 29B) in the shaft end portion 66*c* of the support member 66. Thus, rotating the driven roller shaft 65 (see FIG. 29A) allows the driven roller 62 to swing about the axial line G.

A second driven roller 75 for stretching the developer conveying belt 60 is assembled to the developing frame 28 illustrated in FIGS. 29A and 29B. This will be described with reference to FIG. 30. The developing frame 28 has recessed portions 28*t* and 28*u* at both ends thereof in the longitudinal direction. The second driven roller 75 has shaft portions 75*a* and 75*b* at both ends thereof. The second driven roller 75 is rotatably supported by the developing frame 28 by inserting the shaft portions 75*a* and 75*b* into the recessed portions 28*t* and 28*u*, respectively.

The developing frame 28 and the lid member 50 assembled as described with reference to FIGS. 29A and 29B are joined together, for example, by welding (see FIG. 31A). In this state, a third driven roller 76 is inserted into the inside of one end portion 60*g* of the developer conveying belt 60. Additionally, shaft portions 76*a* and 76*b* at both ends of the third driven roller 76 are inserted into recessed portions 28*v* and 28*w*, respectively, of the developing frame 28. Then, as illustrated in FIG. 31B, the mandible-like member 51 is attached to the developing frame 28 in the direction of arrow to prevent the third driven roller 76 from falling out of the recessed portions 28*v* and 28*w*.

A further description will be given with reference to the cross-sectional views of FIGS. 32A and 32B. FIG. 32A is a cross-sectional view illustrating a loosened state of the developer conveying belt 60. FIG. 32B is a cross-sectional view illustrating a stretched state of the developer conveying belt 60. When the driven roller 62 is rotated in the direction of arrow H, the driven roller 62 swings to stretch the developer conveying belt 60 between the driven roller 62 and the driving roller 61. The lid member 50 is provided with the ribs 50*h* at its bottom. This is to prevent the sprockets 61*a* (see FIG. 28A) at both ends of the driving roller 61 from being disengaged from the holes 60*c* at both ends of the developer conveying belt 60 when the developer conveying belt 60 is loosened. The ribs 50*h* are disposed near the sprockets 61*a* at both ends of the driving roller 61.

FIGS. 33A and 33B are perspective views illustrating a configuration of a securing unit that secures the driven roller 62 for keeping the developer conveying belt 60 in a loosened state (see FIG. 32A) and in a stretched state (see FIG. 32B). FIG. 33A is a perspective view illustrating a state where the developer conveying belt 60 is biased in a loosened state. FIG. 33B is a perspective view illustrating a state where the developer conveying belt 60 is biased in a stretched state. The tension spring 67 serving as a biasing unit is stretched between the boss 65*d* of the driven roller shaft 65 and the boss 28*p* of the developing frame 28. Thus, when the developer conveying belt 60 is in a loosened state, the driven roller 62 is biased toward the inner surface 50*j* (see FIG. 32A) of the lid member 50. When the driven roller shaft 65 is rotated in the direction of arrow H, the developer conveying belt 60 is stretched by the biasing force of the tension spring 67 upon passage of the boss 65*d* of the driven roller shaft 65 over the axial line I which connects the center of the boss 28*p* of the developing frame 28 and the rotation center of the driven roller shaft 65. This configuration allows the developer conveying belt 60 to be reliably stretched, because variation in circumference caused by the tolerance of the developer conveying belt 60 can be accommodated.

A toner conveying configuration of the developing device 4 will now be described in detail with reference to FIG. 25 and FIGS. 27A and 27B. As illustrated in FIG. 25, the developer conveying belt 60 is disposed in the container 28*a* and supported by the driving roller 61, the driven roller 62, the second driven roller 75, and the third driven roller 76 such that it can run in the direction of arrow P. The developer conveying belt 60 extends upward from the lower end of the developing device 4 (at which the developer conveying belt 60 is supported by the driven roller 62) to the upper end of the developing device 4 (at which the developer conveying belt 60 is supported by the driving roller 61) in a substantially vertical direction. At the same time, the developer conveying belt 60 is bent, at the upper end of the developing device 4, at a substantially right angle toward the developing chamber 28*b*.

One end portion of the developer conveying belt 60 is located near the lower end of the container 28*a*, and the other end portion of the developer conveying belt 60 is located in the upper part of the developing chamber 28*b* and above the nip (contact portion) N described above (see FIGS. 27A and 27B).

The developer conveying belt 60 has the fin portions 60*a* extending substantially horizontally in the longitudinal direction of the developing device 4. The fin portions 60*a* are formed to be substantially orthogonal to the belt running direction (direction of arrow P). When the developer conveying belt 60 moves, the fin portions 60*a* are brought close to the developing frame 28 in the vicinity of the driven roller 62, which is near the lower end of the container 28*a*. Then, toner is held in the space defined by the developer conveying belt 60, adjacent fin portions 60*a*, and the lid member 50. This state is maintained while the fin portions 60*a* are being close to the lid member 50, that is, during movement of the fin portions 60*a* from the vicinity of the driven roller 62 to the vicinity of the driving roller 61 along the inner surface 50*j* of the lid member 50. Thus, the toner held between the adjacent fin portions 60*a* at the lower end of the container 28*a* is conveyed to the upper end of the container 28*a* as the developer conveying belt 60 moves. At the location of the driving roller 61, the developer conveying belt 60 turns to the horizontal direction to convey the toner to the developing chamber 28*b*.

As illustrated in FIG. 25, the toner conveyed to the vicinity of the developing chamber 28*b* is supplied to the developing chamber 28*b* at the third driven roller 76. That is, since the fin portions 60*a* are moved clockwise in FIG. 25 as the developer conveying belt 60 runs, the toner retained between adjacent fin portions 60*a* drops into the developing chamber 28*b* by its own weight. The developer conveying belt 60 is configured to make a 180-degree turn at the location of the third driven roller 76. Therefore, the fin portions 60*a* each make a half turn from upward to downward in the vertical direction, so that toner between adjacent fin portions 60*a* can be reliably supplied to the nip N between the toner supply roller 30 and the developing roller 21.

The third driven roller 76 is disposed above the nip N between the toner supply roller 30 and the developing roller 21. The position of the third driven roller 76 is set such that each fin portion 60*a* is turned toward the nip N at the location where the angle of inclination of the fin portion 60*a* exceeds the angle of repose of the developer. That is, the third driven roller 76 is configured such that toner is reliably supplied to the nip N by being dropped by its own weight. As described above, since the fin portion 60*a* is eventually turned downward in the vertical direction, toner on the developer conveying belt 60 is supplied to the developing chamber 28*b* without remaining on the developer conveying belt 60.

A third sheet member (separating member) 77 is attached to the partition 28*j* forming the developing chamber 28*b*. The third sheet member 77 is formed by an elastic sheet. One end of the third sheet member 77 is secured to the partition 28*j*, and the other end of the third sheet member 77 is in contact with the toner supply roller 30. The third sheet member 77 is in contact with the toner supply roller 30 on the downstream side of the contact portion (nip N) between the toner supply roller 30 and the developing roller 21 in the rotation direction of the toner supply roller 30 (i.e., in the direction of arrow C). In the present embodiment, using the developer conveying belt 60 allows toner retained between adjacent fin portions 60*a* to be sequentially supplied in small amounts.

If low-coverage-rate images are continuously printed by the user, an excessive amount of toner may be accumulated at the contact portion (nip N) between the toner supply roller 30 and the developing roller 21. When the amount of toner supply appropriate in the present configuration is the amount of toner (developer) indicated by shaded areas in FIGS. 27A and 27B, toner exceeding this amount may be supplied, for example, as indicated by a two-dot chain line (excess toner portion 96) in FIG. 27B. If, as in this case, the amount of toner supplied toward the nip N by the developer conveying belt 60 exceeds a predetermined amount, the third sheet member 77 separates the excess toner from the toner supply roller 30. As the developer conveying belt 60 runs, the excess toner separated by and accumulated on the third sheet member 77 is scratched off, collected, and conveyed by the fin portions 60*a* after supply of toner, and then collected in the container 28*a*. With this configuration, no toner exceeding a required amount is retained at the nip N between the toner supply roller 30 and the developing roller 21.

After collecting the excess toner from the excess toner portion 96 (see FIG. 27B) and conveying the collected toner to the container 28*a*, each fin portion 60*a* is turned to move downward in the vertical direction at the location of the second driven roller 75 (see FIG. 25). The fin portion 60*a* overrides the second driven roller 75 as it passes through the second driven roller 75. As described above, a resin sheet made of polyethylene terephthalate (PET) resin, polycarbonate (PC) resin, polyphenylene sulfide (PPS) resin, or the like is used to form the developer conveying belt 60. Also, the developer conveying belt 60 is in a stretched state. Therefore, when the fin portion 60*a* comes into contact with and overrides the second driven roller 75, the fin portion 60*a* falls backward in the direction of travel of the developer conveying belt 60 by the elasticity of the resin sheet, and passes over the second driven roller 75 as the developer conveying belt runs. In the present embodiment, to stabilize the stretched state maintained by the driven roller 62, the second driven roller 75 has a cylindrical shape with a uniform diameter in the longitudinal direction (see FIG. 30). Alternatively, the driven roller 62 may have a smaller diameter at portions overlapping the fin portions 60*a* in the longitudinal direction (axial direction) than at end portions thereof. This reduces warpage of the fin portions 60*a* that occurs when the developer conveying belt 60 passes over the second driven roller 75, and thus allows smooth running of the developer conveying belt 60.

Toner is sequentially supplied to the developing roller 21 and the photosensitive drum 1. Toner dropped from the toner supply roller 30 or developing roller 21 into a second developing chamber 28*b*2 is collected through the discharge opening 28*f* in the container 28*a*. It is thus possible to prevent occurrence of toner packing in the developing chamber.

In the present embodiment, an amount of toner required for development is supplied above the toner supply roller 30. Therefore, unlike the case of fixing toner to the toner supply roller by pressure below the developing roller, the occurrence of toner packing can be prevented.

The fin portions 60*a* of the developer conveying belt 60 are arranged at intervals that can maintain a sufficient amount of toner supply during image formation.

As described above, toner in the container 28*a* is conveyed by the developer conveying belt 60 while being retained in small amounts between adjacent fin portions 60*a*, and then is supplied to the developing chamber 28*b*. After only the amount required for development is supplied to the developing roller 21, excess toner is collected in the container 28*a*. In other words, toner circulates between the container 28*a* and the developing chamber 28*b*.

As described above, the present embodiment uses the developer conveying belt 60 in the developing device 4 in which the container 28*a* is disposed below the developing chamber 28*b*. This allows toner to be supplied, in small amounts, above the toner supply roller 30 and the developing roller 21. Also, an amount of toner sufficient for development can be retained at the nip N between the toner supply roller 30 and the developing roller 21.

After conveying toner, the developer conveying belt collects excess toner at the nip and conveys it. It is thus possible to always supply only as much toner as required for development, and to prevent image quality from being negatively affected by toner packing in the developing chamber. Additionally, since excess toner is collected in the container by the developer conveying belt, toner can circulate between the developing chamber and the container. This can prevent an imbalance in the distribution of toner degradation in the developing device.

The present embodiment provides a developing device, a process cartridge, and an image forming apparatus capable of maintaining good toner circulation between a developing chamber and a container while supplying a sufficient amount of toner to the developing chamber, and thereby producing high-quality images.

The present invention can ensure stable supply of a developer to the developing chamber.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-151531 filed Jul. 31, 2015, which is hereby incorporated by reference herein in its entirety.

What is claimed is:

1. A developing device comprising:

a developer bearing member for bearing a developer;

a regulating member for regulating a thickness of the developer on the developer bearing member;

a developing chamber having the developer bearing member and the regulating member; and a container configured to contain the developer, and having an endless developer conveying belt with at least one fin portion for conveying the developer to the developing chamber, wherein at least a part of the container is disposed directly below the developing chamber in the vertical direction.

2. The developing device according to claim 1, wherein the developer conveying belt is stretched over a driving roller and a plurality of driven rollers.

3. The developing device according to claim 1, wherein a plurality of fin portions are arranged in an axial direction of the developer bearing member and a conveying direction of the developer conveying belt.

4. The developing device according to claim 1, wherein the developer conveying belt runs upward in the vertical direction while allowing an end of the fin portion to slide and rub against an inner wall of a developing frame forming the developing chamber and the container, thereby conveying the developer in the container to the developing chamber.

5. The developing device according to claim 4, wherein when brought into contact with the inner wall of the developing frame, the fin portion is inclined toward an upstream side in a running direction of the developer conveying belt.

6. The developing device according to claim 1, wherein the fin portion is brought into contact with a part of a developing frame forming the developing chamber below a roller in the vertical direction, the roller being located in the developing chamber and being one of a plurality of rollers over which the developer conveying belt is stretched.

7. The developing device according to claim 1, further comprising:

a developer supply member disposed in the developing chamber and configured to supply the developer to the developer bearing member;

a supply opening configured to allow the developer to be supplied from the container to the developing chamber;

a discharge opening disposed below the supply opening in the vertical direction and configured to allow the developer to be returned from the developing chamber to the container; and a conveying sheet member configured to be in contact with a lower part of the developer supply member and extend at an angle from the supply opening toward the discharge opening, wherein the developer conveying belt runs to bring the fin portion into and out of contact with an end portion of the conveying sheet member on the supply opening side.

8. The developing device according to claim 7, wherein the conveying sheet member has elasticity, warps when the fin portion of the running developer conveying belt is brought into contact therewith, and vibrates by an elastic force in a direction toward and away from the developer supply member when brought out of contact with the fin portion.

9. The developing device according to claim 7, wherein the conveying sheet member has a bent portion at an end thereof on the discharge opening side.

10. The developing device according to claim 7, further comprising a separating member disposed in the developing chamber and configured to be in contact with the developer supply member on a downstream side of a contact portion between the developer supply member and the developer bearing member in a rotation direction of the developer supply member, wherein the developer conveying belt conveys the developer to the vicinity of the contact portion between the developer supply member and the developer bearing member from above the developer supply member; and when the amount of developer supplied to the contact portion exceeds a predetermined amount, a developer separated from the developer supply member by the separating member and accumulated on the separating member is collected in the container.

11. The developing device according to claim 10, wherein the developer exceeding the predetermined amount is conveyed by the fin portion of the developer conveying belt from above the separating member to the container.

12. The developing device according to claim 10, wherein one end portion of the developer conveying belt is located near a lower end of the container, and the other end portion of the developer conveying belt is located in an upper part of the developing chamber and above the contact portion.

13. The developing device according to claim 10, wherein the developing chamber has the discharge opening below the contact portion, the discharge opening being configured to allow a developer dropped from the developer bearing member and the developer supply member to be discharged to the container.

14. The developing device according to claim 10, wherein a downstream end of the contact portion in the rotation direction of the developer supply member is located above an upstream end of the contact portion.

15. The developing device according to claim 1, further comprising a residual quantity detector configured to detect a residual quantity of the developer, wherein an inner wall of the container facing a side of the developer conveying belt on which the developer is conveyed to the developing chamber is provided with a light emitting element and a light receiving element opposite each other, the light emitting element being configured to guide light emitted from the residual quantity detector to the container, the light receiving element being configured to receive the light guided by the light emitting element and passing through the container and guide the received light to the residual quantity detector; and at least one of fin portions of the developer conveying belt has an inclined surface inclined with respect to a developer conveyance direction and a longitudinal direction of the developer conveying belt, and has a hole on a downstream side of the inclined surface in the developer conveyance direction.

16. The developing device according to claim 15, wherein the developer is held in a space in the vicinity of a lower end of the container and conveyed upward in the vertical direction, the space being surrounded by the developer conveying belt, adjacent fin portions, and the container.

17. The developing device according to claim 15, wherein the fin portion having the inclined surface is a V-shaped fin portion having the hole in a center thereof in the longitudinal direction of the developer conveying belt, the fin portion being inclined toward the hole.

18. The developing device according to claim 15, wherein the fin portion having the inclined surface has at least one slit.

19. A process cartridge comprising:

the developing device according to claim 1; and an image bearing member configured to bear a developer image thereon.

20. An image forming apparatus comprising the developing device according to claim 1, wherein the image forming apparatus is configured to form an image on a recording medium using a developer.

21. An image forming apparatus comprising:

an image bearing member;

a developing device comprising:

a developer bearing member for bearing a developer;

a developing chamber having the developer bearing member; and a container disposed below the developing chamber in a vertical direction, configured to contain the developer, and having an endless developer conveying belt with at least one fin portion for conveying the developer to the developing chamber, a latent image forming unit configured to form an electrostatic latent image on the image bearing member, and disposed directly below the developing device in the vertical direction.

22. The image forming apparatus according to claim 21, wherein the developer conveying belt is stretched over the driving roller and a plurality of driven rollers.

23. The image forming apparatus according to claim 21, wherein a plurality of fin portions and a plurality of openings are arranged in a conveying direction of the developer conveying belt.

24. The image forming apparatus according to claim 23, wherein an end of the fin portion is configured to rub against an inner wall of a developing frame forming the developing chamber and the container.

25. The image forming apparatus according to claim 24, further comprising a residual quantity detector configured to detect a residual quantity of the developer.

* * * * *